US008063863B2

(12) United States Patent
Yano et al.

(10) Patent No.: US 8,063,863 B2
(45) Date of Patent: Nov. 22, 2011

(54) PICTURE DISPLAY APPARATUS AND METHOD

(75) Inventors: Tomoya Yano, Kanagawa (JP); Makio Iida, Tokyo (JP); Yoshiki Shirochi, Chiba (JP)

(73) Assignee: Sony Corporation (JP)

( * ) Notice: Subject to any disclaimer, the term of this patent is extended or adjusted under 35 U.S.C. 154(b) by 643 days.

(21) Appl. No.: 11/662,842

(22) PCT Filed: Jun. 15, 2006

(86) PCT No.: PCT/JP2006/312068
§ 371 (c)(1),
(2), (4) Date: Dec. 17, 2007

(87) PCT Pub. No.: WO2006/135025
PCT Pub. Date: Dec. 21, 2006

(65) Prior Publication Data

US 2008/0284699 A1 Nov. 20, 2008

(30) Foreign Application Priority Data

Jun. 15, 2005 (JP) ..... 2005-175550

(51) Int. Cl.
*G09G 3/36* (2006.01)
*G09G 5/10* (2006.01)

(52) U.S. Cl. ..... 345/89; 345/690

(58) Field of Classification Search ..... 345/690, 345/87–103, 204–213, 691
See application file for complete search history.

(56) References Cited

U.S. PATENT DOCUMENTS 6,870,530 B2 * 3/2005 Bu et al. ..... 345/208
2003/0006952 A1 1/2003 Hong
(Continued)

FOREIGN PATENT DOCUMENTS

JP 2004-233949 A 8/2004
(Continued)

OTHER PUBLICATIONS

Supplementary European Search Report, EP 06757365, dated Mar. 9, 2010.

(Continued)

*Primary Examiner* — Amare Mengistu
*Assistant Examiner* — Hong Zhou
(74) *Attorney, Agent, or Firm* — Lerner, David, Littenberg, Krumholz & Mentlik, LLP

(57) ABSTRACT

A picture display apparatus exploiting a liquid crystal display is disclosed. This picture display apparatus (10) includes an interpolator (11), an over-drive unit (12), an angle of visibility improvement unit (13), and a source driver (15) for driving a liquid crystal display panel (16). The interpolator converts the picture rate upwardly. The angle of visibility improvement unit (13) converts an input picture signal into a picture signal representing a grayscale level of the input picture signal by synthesis of liquid crystal transmittances of a plural number of temporally consecutive fields. Specifically, the angle of visibility improvement unit converts the input picture signal to a picture signal made up of a first field set to a signal value related with a high grayscale level and a second field set to a signal value related with a low grayscale level. In case time changes of the grayscale level have occurred in the input picture signal at the same spatial position, the over-drive unit (12) corrects the driving level for a signal value of one or both of the first and second fields depending on response of the liquid crystal.

28 Claims, 28 Drawing Sheets

U.S. PATENT DOCUMENTS

| | | | | |
|---|---|---|---|---|
| 2003/0156092 | A1 | 8/2003 | Suzuki et al. | |
| 2004/0130559 | A1* | 7/2004 | Lee et al. | 345/690 |
| 2004/0135800 | A1* | 7/2004 | Shiomi et al. | 345/691 |
| 2004/0246224 | A1 | 12/2004 | Tsai et al. | |
| 2005/0078069 | A1 | 4/2005 | Aiba et al. | |
| 2005/0104824 | A1 | 5/2005 | Shen et al. | |
| 2005/0140626 | A1* | 6/2005 | Doyen et al. | 345/89 |
| 2005/0146495 | A1* | 7/2005 | MacKinnon et al. | 345/98 |

FOREIGN PATENT DOCUMENTS

| | | | |
|---|---|---|---|
| JP | 2004-240317 | A | 8/2004 |
| JP | 2004-246312 | A | 9/2004 |
| JP | 2004361943 | A | 12/2004 |
| JP | 2005-062868 | A | 3/2005 |
| JP | 2005-173387 | A | 6/2005 |
| JP | 2006098244 | A | 4/2006 |
| JP | 2006343706 | A | 12/2006 |
| JP | 2006343707 | A | 12/2006 |

OTHER PUBLICATIONS

Office Action from Japanese Application No. 2005-175550, dated Apr. 5, 2011.

* cited by examiner first table

| $S_{n+2}$ \ $S_n$ | 0 | | | 10 | | | 32 | | | 64 | | | 128 | | | 166 | | |
|---|---|---|---|---|---|---|---|---|---|---|---|---|---|---|---|---|---|---|
| | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ |
| 0 | | | | | | | | | | | | | | | | | | |
| 10 | | | | | | | | | | | | | | | | | | |
| 32 | | | | | | | | | | | | | | | | | | |
| 64 | | | | | | | | | | | | | | | | | | |
| 128 | | | | | | | | | | | | | | | | | | |
| 166 | | | | | | | | | | | | | | | | | | |

FIG. 14 second table

| $S_{n+1}$ \ $S_n$ | 0 | | | 10 | | | 32 | | | 64 | | | 128 | | | 166 | | | 192 | | | 224 | | | 255 | | |
|---|---|---|---|---|---|---|---|---|---|---|---|---|---|---|---|---|---|---|---|---|---|---|---|---|---|---|---|
| | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ |
| 0 | | | | | | | | | | | | | | | | | | | | | | | | | | | |
| 10 | | | | | | | | | | | | | | | | | | | | | | | | | | | |
| 32 | | | | | | | | | | | | | | | | | | | | | | | | | | | |
| 64 | | | | | | | | | | | | | | | | | | | | | | | | | | | |
| 128 | | | | | | | | | | | | | | | | | | | | | | | | | | | |
| 166 | | | | | | | | | | | | | | | | | | | | | | | | | | | |
| 192 | | | | | | | | | | | | | | | | | | | | | | | | | | | |
| 224 | | | | | | | | | | | | | | | | | | | | | | | | | | | |
| 255 | | | | | | | | | | | | | | | | | | | | | | | | | | | |

FIG.15 third table

| $S_{n+2}$ \ $S_{n+1}$ | 0 | | | 10 | | | 32 | | | 64 | | | 128 | | | 166 | | | 192 | | | 224 | | | 255 | | |
|---|---|---|---|---|---|---|---|---|---|---|---|---|---|---|---|---|---|---|---|---|---|---|---|---|---|---|---|
| | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ | $S_{n+1}$ | $S_{n+2}$ | $S_{n+2'}$ |
| 0 | | | | | | | | | | | | | | | | | | | | | | | | | | | |
| 10 | | | | | | | | | | | | | | | | | | | | | | | | | | | |
| 32 | | | | | | | | | | | | | | | | | | | | | | | | | | | |
| 64 | | | | | | | | | | | | | | | | | | | | | | | | | | | |
| 128 | | | | | | | | | | | | | | | | | | | | | | | | | | | |
| 166 | | | | | | | | | | | | | | | | | | | | | | | | | | | |
| 192 | | | | | | | | | | | | | | | | | | | | | | | | | | | |
| 224 | | | | | | | | | | | | | | | | | | | | | | | | | | | |
| 255 | | | | | | | | | | | | | | | | | | | | | | | | | | | |

FIG. 16

PICTURE DISPLAY APPARATUS AND METHOD

TECHNICAL FIELD

This invention relates to a picture display apparatus and a picture display method for displaying an output picture via a liquid crystal display surface.

The present application claims priority rights based on the JP Patent Application 2005-175550, filed in Japan on Jun. 15, 2005. This patent application of the earlier filing data is incorporated into the present application by reference.

BACKGROUND ART

In a conventional direct-view liquid crystal display, there is produced a difference in a picture birefringence phase difference (retardation), depending on the angle of visibility (angle with which the display is viewed), with the result that the picture displayed on the display appears as if the picture has been changed in color. This problem is routinely coped with by an optical compensation plate introduced between the optical compensation plate and the liquid crystal layer to improve the retardation.

Although sufficient improvement may be achieved in case of displaying black (lowest luminance) or white (highest luminance), such is not the case with displaying intermediate luminance. For example, even though the input grayscale-luminance characteristics are γ characteristics shown at P in FIG. 30, with the angle of visibility of 0° (in case of viewing the display from the front side), the input grayscale-luminance characteristics in case of viewing the display at an angle of visibility of 60° (in case of viewing the display from an angle of 60°) depart from the γ characteristics, as indicated at Q in FIG. 30.

Meanwhile, the processing for improving display characteristics for moving pictures, termed over-drive processing and black-insertion processing, is used in a direct-viewing liquid crystal display. The over-drive processing is a technique of slightly increasing the driving voltage for the liquid crystal, in case a picture is transitioning, in such a manner as to raise follow-up characteristics of the liquid crystal. The black-insertion processing is the processing of displaying a black picture before a picture image transitions to the next picture image to prohibit the picture image from becoming blurred due to a residual image on the retina of the human eye.

DISCLOSURE OF THE INVENTION

Problem to be Solved by the Invention

It is a technical task of the present invention to provide an apparatus and a method for improving angle-of-visibility characteristics of the liquid crystal display and for improving display characteristics of a moving picture.

In one aspect, the present invention provides a picture display apparatus for displaying a picture corresponding to an input picture signal via a liquid crystal display surface. The apparatus includes a driving level correction unit for correcting a driving level based on the input picture signal, a converter for converting the grayscale level of a signal supplied thereto into a plurality of correction levels for expressing the grayscale level by synthesis of transmittances of a plurality of temporally consecutive fields, and a driving unit for driving the liquid crystal display surface by a driving signal generated via the driving level correction unit and the converter. The converter generates the correction levels so that each picture image of the input picture signal includes at least a first field and a second field. The first field has transmittance converted to a transmittance corresponding to the grayscale level of the input picture signal added by a positive correction value. The second field has transmittance converted to a transmittance corresponding to the grayscale level of the input picture signal added by a negative correction value. The driving level correction unit performs driving level correction of signal values of the first field or the second field or both, depending on effective response characteristics of the liquid crystal driven by the driving unit, in case time changes of the grayscale level have occurred at the same spatial position of the input picture signal.

In another aspect, the present invention provides a picture display method for displaying a picture corresponding to an input picture signal via a liquid crystal display surface. The method includes a driving level correction step of correcting a driving level based on the input picture signal, a converting step of converting the grayscale level of a signal supplied thereto into a plurality of correction levels for expressing the grayscale level by synthesis of transmittances of a plurality of temporally consecutive fields, and a driving step of driving the liquid crystal display surface by a driving signal generated by the driving level correction step and the converting step. The converting step generating the correction levels so that each picture image of the input picture signal includes at least a first field and a second field. The first field has transmittance converted to a transmittance corresponding to the grayscale level of the input picture signal added by a positive correction value. The second field has transmittance converted to a transmittance corresponding to the grayscale level of the input picture signal added by a negative correction value. The driving level correction step performs driving level correction of signal values of the first field or the second field or both, depending on effective response characteristics of the liquid crystal driven by the driving step, in case time changes of the grayscale level have occurred at the same spatial position of the input picture signal.

In the apparatus and method for picture display, according to the present invention, an input picture signal is converted into a corrected picture signal in which a grayscale level of the input picture signal is expressed by synthesis of liquid crystal transmittances of a plural number of temporally consecutive fields. The corrected picture signal includes, for each picture image of the input picture signal, at least a first field set to transmittance corresponding to a grayscale level higher than a grayscale level of the input picture signal and a second field set to transmittance corresponding to a grayscale level lower than the grayscale level of the input picture signal. In case time changes of the grayscale level are produced at the same spatial position in the input picture signal, signal values of one or both of the first and second fields are corrected in level depending on the response speed of the liquid crystal. By so doing, the angle of visibility characteristics are improved, while the moving picture may properly be prohibited from becoming blurred in keeping with response characteristics of the liquid crystal.

Other objects and advantages derived from the present invention will become more apparent from the following description which will now be made in conjunction with the accompanying drawings.

BRIEF DESCRIPTION OF THE DRAWINGS

FIG. 14 shows a first table.

FIG. 15 shows a second table.

FIG. 16 shows a third table.

BEST MODE FOR CARRYING OUT THE INVENTION

As the best mode for carrying out the present invention, a picture display apparatus for displaying an input picture signal on a liquid crystal display panel will now be described in detail.

Overall Structure

Figure 1:
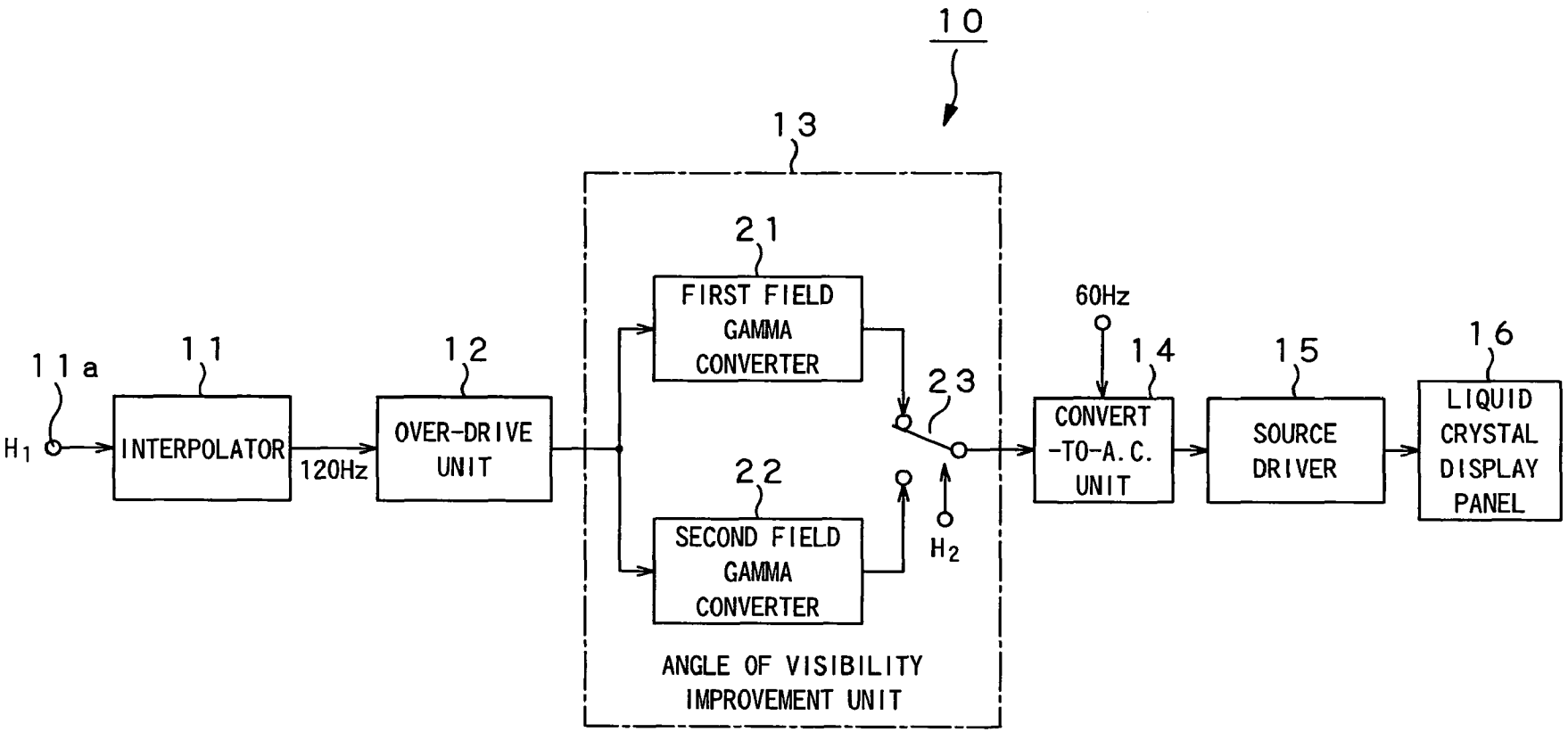
FIG. 1 is a block circuit diagram showing an embodiment of a picture display apparatus according to the present invention.

Referring to FIG. 1, a picture display apparatus 10 according to the present invention includes an interpolator 11, an over-drive unit 12, an angle of visibility improvement unit 13, a convert-to-A.C. unit 14, a source driver 15 and a liquid crystal display panel 16. A digital picture signal $H_1$ of a picture rate of 60 Hz, for example, is supplied from outside via an input terminal 10*a* of the picture display apparatus 10. Specifically, this digital picture signal $H_1$ is supplied via input terminal 10*a* to the interpolator 11. The interpolator 11 redoubles the picture rate of the 60 Hz picture signal to 120 Hz by rate conversion. In redoubling the picture rate of the picture signal, the interpolator 11 generates picture image portions, which would be insufficient, by interpolation of corresponding picture image portions from e.g. temporally forward or backward pictures. The method for interpolation is arbitrary. By this upward rate conversion, it is possible to eliminate blurring, such as dual image, which tends to be generated when a moving subject is follow-up viewed.

The picture signal, the picture rate of which has been converted to 120 Hz by the interpolator 11, is supplied to the over-drive unit 12. The over-drive unit 12 corrects a driving signal to an optimum level signal, in keeping with the response characteristics of the liquid crystal, in case there is a level change in the input picture signal. More specified processing contents of the over-drive unit 12 will be described subsequently.

The angle of visibility improvement unit 13 expresses a sole grayscale level of the original 60 Hz picture signal, by two picture images (fields) arrayed in the time direction of the picture signal, the picture rate of which has been up-converted to 120 Hz, such as to improve angle-of-visibility characteristics. The specified processing by the angle of visibility improvement unit 13 will be described subsequently.

The convert-to-A.C. unit 14 is supplied with the picture signal of the picture rate of 120 Hz from the angle of visibility improvement unit 13. The convert-to-A.C. unit 14 converts the polarity of the driving of the liquid crystal to alternating positive and negative polarities. The liquid crystal molecules are oriented in the same direction in case the direction and the magnitude of the vector of the electrical field applied remain the same, despite the difference in polarity of 180°. For this reason, the driving signal is inverted in polarity at a preset period to convert the driving signal into an A.C. signal, such as to establish D.C. balance. The convert-to-A.C. unit 14 takes charge of converting the driving signal into the corresponding A.C. signal.

It is noted that the convert-to-A.C. unit 14, supplied with the input picture signal of 120 Hz, inverts the polarity of the driving signal for converting the polarity of liquid crystal driving to an A.C. signal at 60 Hz for the input 120 Hz picture signal. The reason the polarity of the driving signal is inverted at 60 Hz, even though the field rate is 120 Hz, is that, since the angle of visibility improvement unit 13 has performed the processing for expressing a sole grayscale level with two picture images (fields) neighboring to each other in the time direction, the D.H, balance would be upset if convert-to-A.C. processing is effected at 120 Hz.

The frequency for polarity inversion is not limited to 60 Hz, such that it is sufficient that polarity inversion is made with a multiple of the period necessary for expressing a sole grayscale level. For example, the frequency for polarity inversion for expressing the sole grayscale level may be 120 Hz for a 240 Hz picture signal.

The source driver 15 is supplied with a signal having the polarity inverted by the convert-to-A.C. unit 14. The source driver 15 is responsive to the input signal to apply a driving voltage to the liquid crystal display panel 16 to drive the liquid crystal on the pixel-by-pixel basis.

The liquid crystal display panel 16 is driven by the source driver 15 to display an input moving picture on a panel. The liquid crystal display panel 16 exploits a so-called effective value response type liquid crystal of a twisted nematic mode, employing the nematic liquid crystal, or a perpendicular orientation mode, with a relatively slow liquid crystal response speed, in which the transmittance corresponds to the effective value (mean square) of the voltages applied to the liquid crystal in the plural fields.

Processing for Improving the Angle of Visibility

The angle of visibility improvement unit 13 will now be described in further detail.

Meanwhile, each picture of a picture signal, the picture surface display rate of which has been up-converted to 120 Hz, is referred to below as a field. It should be noted that, although the picture signal is termed a field, it is irrelevant to the field of the interlaced scanning.

Referring to FIG. 1, the angle of visibility improvement unit 13 includes a first field gamma converter 21, a second field gamma converter 22 and a switching output unit 23.

Each of the first field gamma converter 21 and the second field gamma converter 22 is supplied with a picture signal $H_2$ of 120 Hz output from the over-drive unit 12. The first field gamma converter 21 corrects the level of the input picture signal to the plus side, while the second field gamma converter 22 corrects the level of the input picture signal to the minus side.

Meanwhile, the field corrected for level to the plus side is termed a 'first field', while the field corrected for level to the minus side is termed a 'second field'.

The switching output unit 23 alternately selects the picture signal, output from the first field gamma converter 21, and the picture signal, output from the second field gamma converter 22, on the field-by-field basis, that is, at 120 Hz, to output the so selected signals.

The angle of visibility improvement unit 13 outputs a picture signal which is an alternate repetition of fields corrected for level to the plus side (first fields) and fields corrected for level to the minus side (second fields).

The first field gamma converter 21 and the second field gamma converter 22 convert the levels of the first and second fields so that, when the first and second fields are averaged, the resultant picture signal will be the picture signal of the same level as the input 60 Hz picture signal (input picture signal).

Instead of correcting the level of the picture signal on the field-by-field basis, the input reference voltage pattern, supplied to the source driver of the liquid crystal display panel, may be switched on the field-by-field basis. The reference voltage means the voltage applied to the liquid crystal as selected for input data to the source driver. In this case, the signal is supplied to the source driver without correction, and the signal-level-related voltages, applied to the liquid crystal, are switched on the field-by-field basis.

It is noted that the visual sense of the human eye exhibits integrating properties in the time direction. Thus, if the field corrected to the plus side (first field) and the field corrected to the minus side (second field) are alternately displayed, the image being displayed is perceived as a picture of the averaged level. Hence, a user viewing the picture displayed on the liquid crystal display panel 16 is viewing, as it were, a picture signal represented at an averaged level of the first and second fields. Thus, even though the level conversion has been made in the first field gamma converter 21 and in the second field gamma converter 22, the user will feel that he/she is viewing a picture representing the 60 Hz input picture signal.

Figure 2:
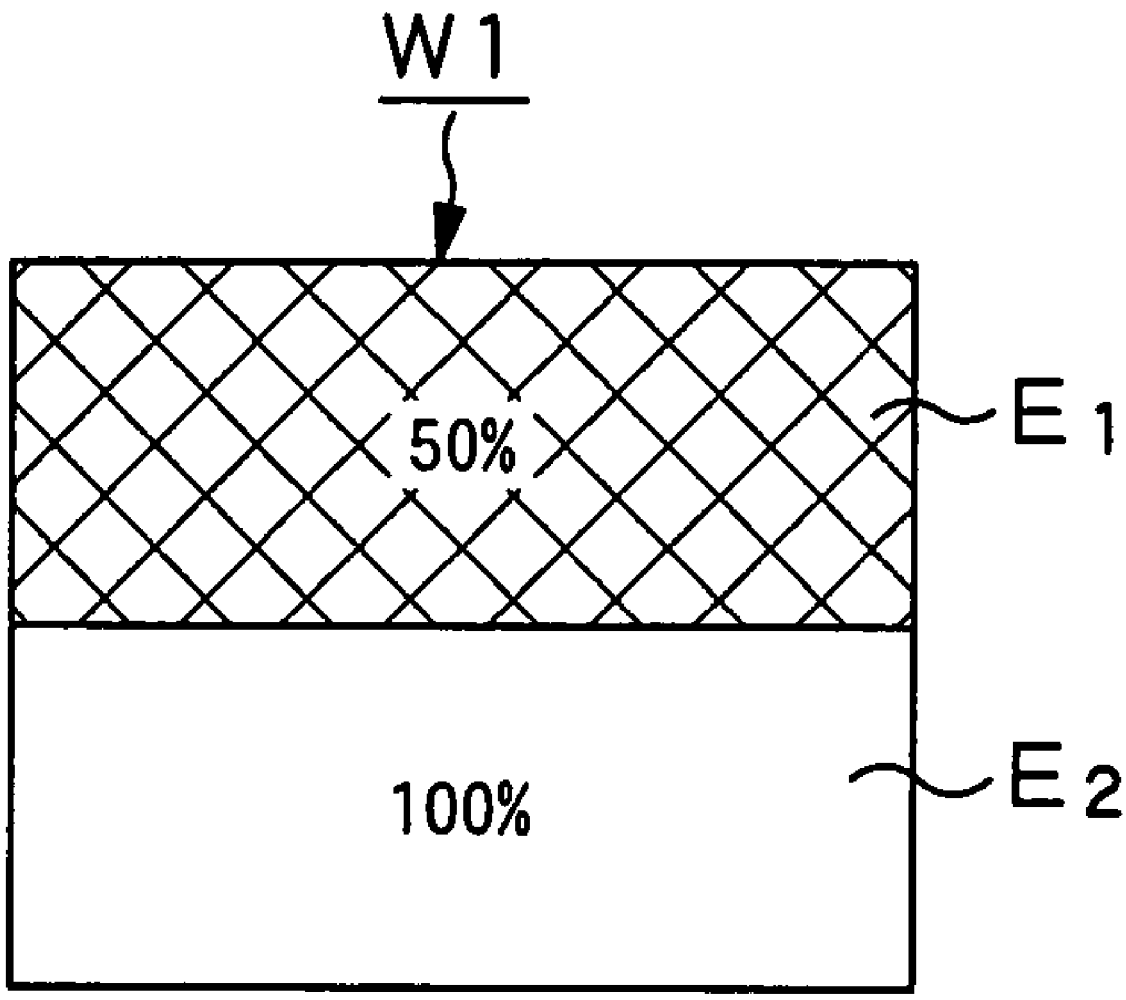
FIG. 2 is a plan view showing a picture image an upper half of which is a region represented by 50% transmittance grayscale and a lower half of which is a region represented by 100% transmittance grayscale.

It is now assumed that a picture image W1 shown in FIG. 2 has been supplied as an input picture signal, and that an upper half region $E_1$ and a lower half region $E_2$ thereof are a region displayed with the grayscale level of 50% transmittance and a region displayed with the grayscale level of 100% transmittance, respectively.

In this case, the first field becomes an image the entire surface region of which is represented with the grayscale of 100% transmittance. The second field becomes an image an upper half surface region of which is represented with the grayscale of 0% transmittance and a lower half surface region of which is represented with the grayscale of 100% transmittance. Since these fields, that is, the first and second fields, are alternately displayed, in the picture display apparatus 10, the second field displayed is such a picture image the upper half region of which is perceived as being of, as it were, the transmittance synthesized from 0% and 100%, or the transmittance of 50%. In actuality, the transmittance corresponds to the effective value of the voltages sample-held in each field and the above description is for ease in understanding the principle.

Figure 3:
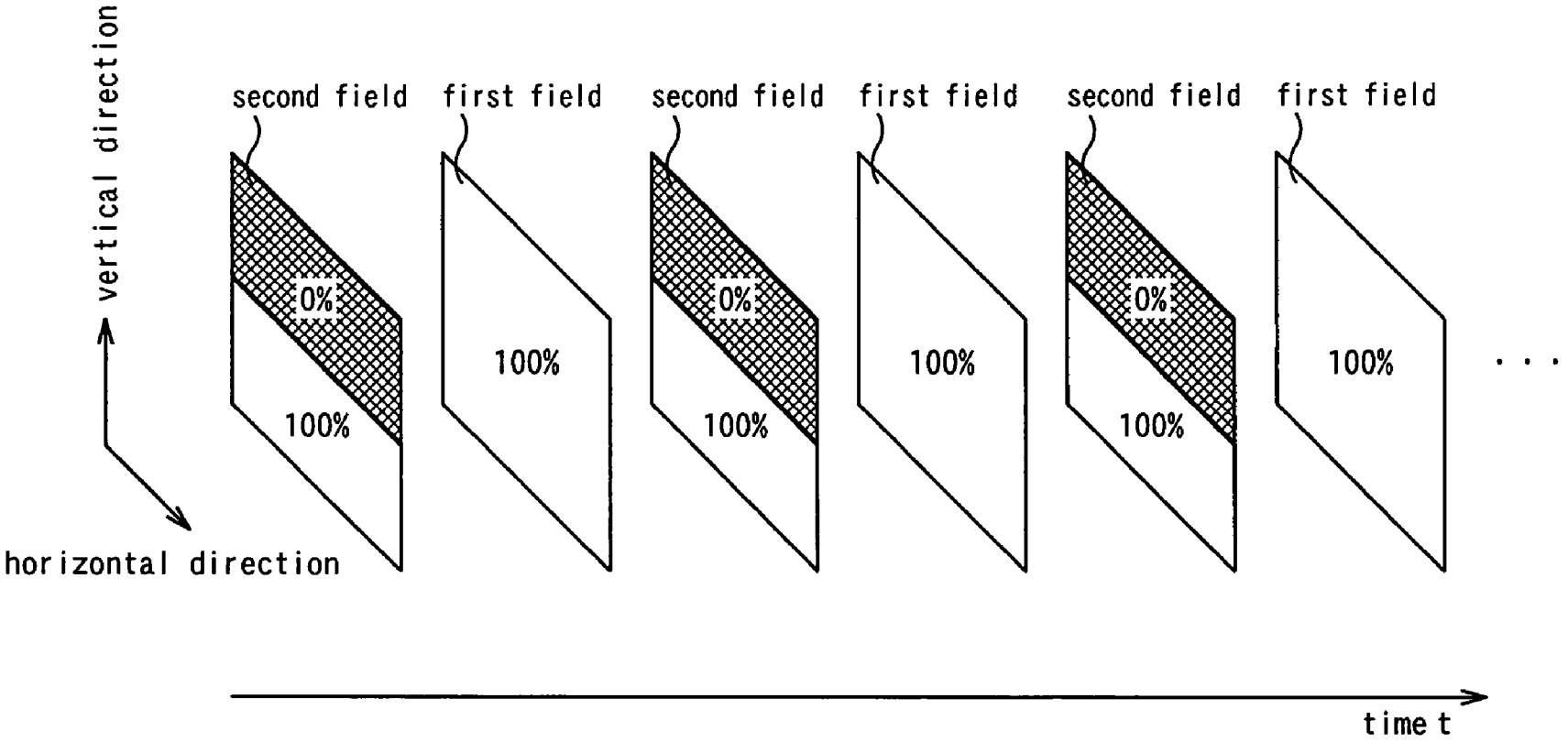
FIG. 3 shows pictures of first and second fields in which the picture image shown in FIG. 2 is improved in grayscale.
Figure 4:
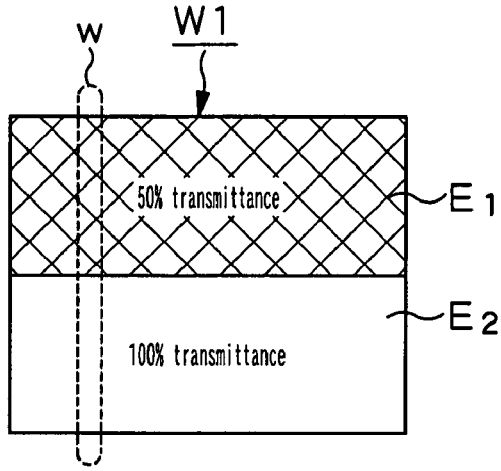
FIG. 4 shows a pixel column w in the vertical direction in a picture image W1.

It is noted that, in the representation shown in FIG. 3, it may appear as if the applied voltage to all pixels of the field is switched simultaneously. However, the actual liquid crystal driving is so-called line-sequential driving in which the driving timing is shifted depending on vertical positions. For example, the actual liquid crystal driving timing of a given pixel column w in a given perpendicular direction on the picture image W1, expressed as shown in FIG. 4, is not the same from one vertical position to another.

Figure 5:
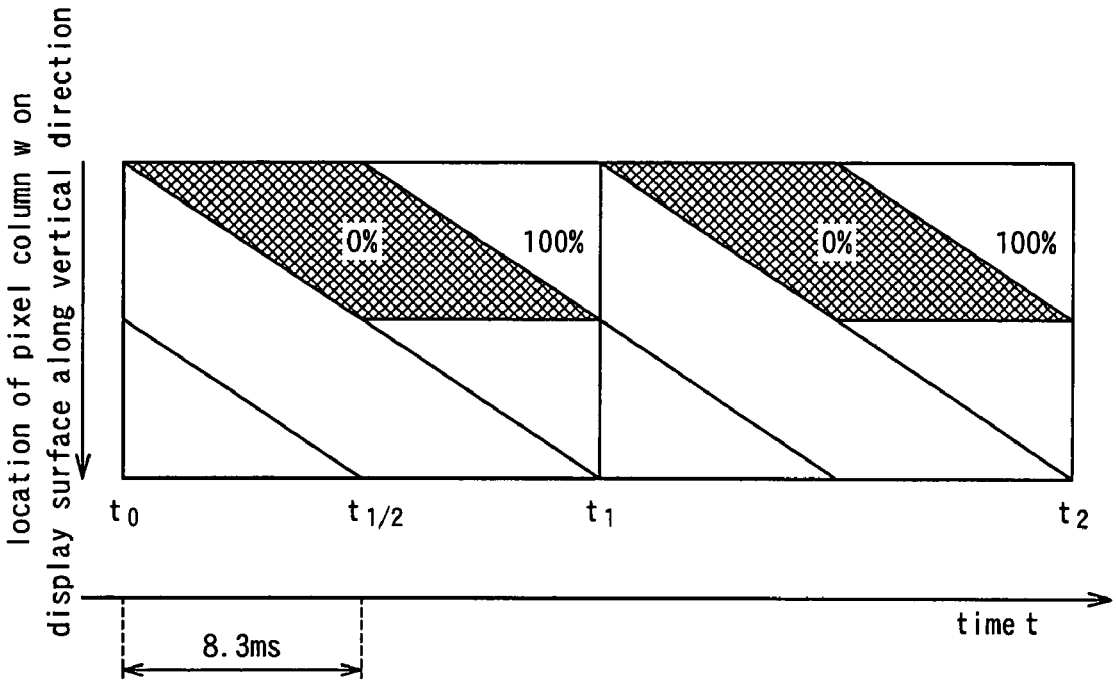
FIG. 5 shows a driving example for driving the pixel column w shown in FIG. 4.

It is also possible to alternately select and scan pixels, not neighboring to one another in the vertical direction, as shown in FIG. 5, in place of selecting and scanning vertically neighboring pixels by line-sequential driving. In the case of this driving method, it is possible, by varying the alternately selected pixel positions in the vertical direction, to set an optional ratio of the time width of the field corrected in level to the plus side and that of the field corrected in level to the minus side, in place of setting the two time widths to an equal time width. For example, the angle-of-visibility improving effect for a low grayscale level may be achieved by setting the time width of the field, level-corrected to the plus side, so as to be smaller than that of the field level-corrected to the minus side.

It is now described, in detail, how the correction (viz. level conversion) is carried out for the first and second fields.

Figure 6:
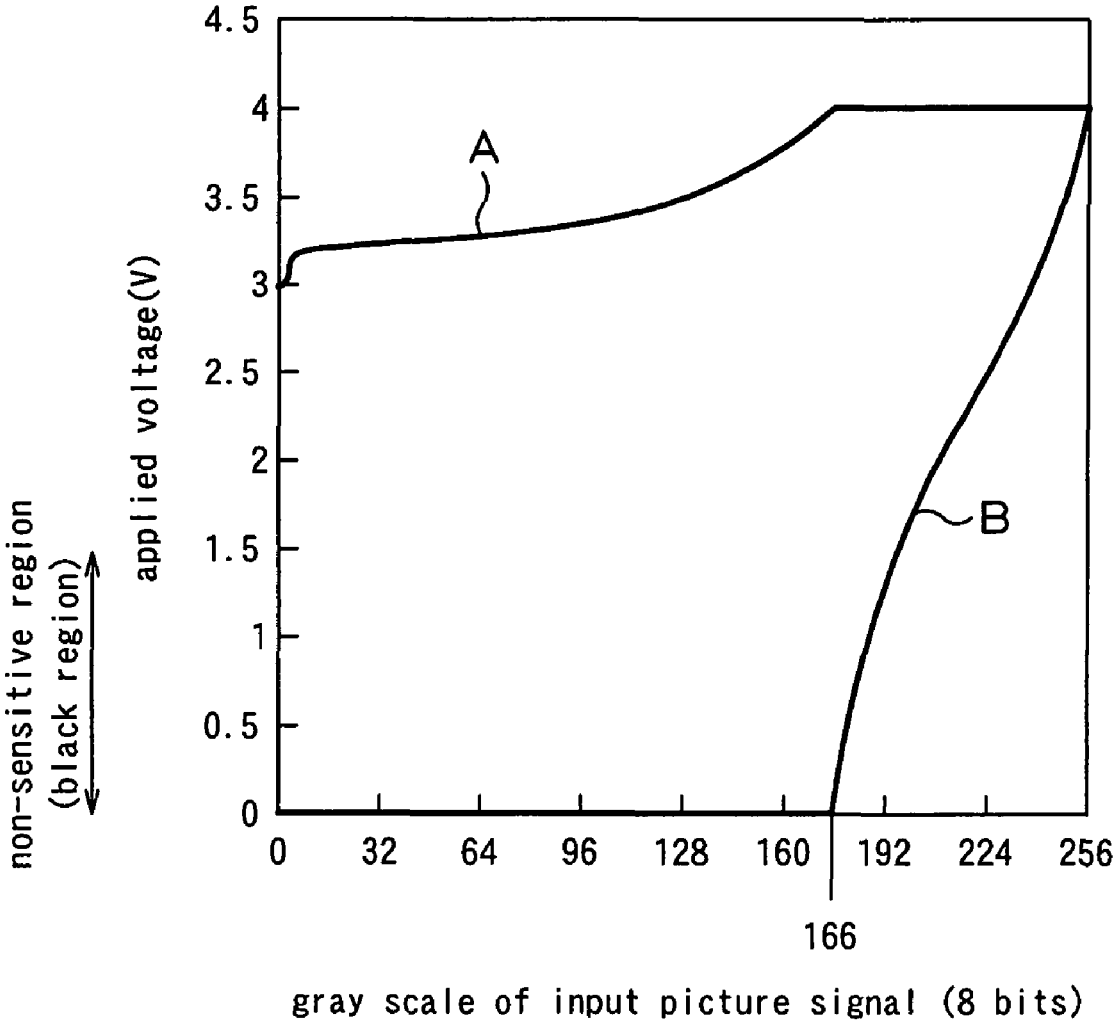
FIG. 6 is a graph showing the relationship between the grayscale of an input picture signal and a voltage applied to the first field and the relationship between the grayscale of an input picture signal and a voltage applied to the second field.

FIG. 6 depicts a graph showing a curve A representing the relationship of the voltage applied to the first field with respect to the grayscale of the input picture signal (in eight bits), and a curve B representing the relationship of the voltage applied to the second field with respect to the grayscale of the input picture signal (in eight bits).

The first field gamma converter 21 computes the applied voltage in accordance with the curve A shown in FIG. 6 to generate a signal corresponding to the so computed applied voltage. The second field gamma converter 22 computes the applied voltage in accordance with the curve B shown in FIG. 6 to generate a signal corresponding to the so computed applied voltage.

It is assumed that a voltage in absolute value which is not lower than 0V and not higher than 4V may be applied to the liquid crystal display panel 16. With the liquid crystal display panel 16, color density becomes 100% transmittance (white representation) in case 4V is applied. With the liquid crystal display panel 16, the color density (transmittance) becomes smaller as the applied voltage is lowered from 4V, until the color density becomes 0% transmittance (black representation) at 1.5V. The applied voltage from 0V to 1.5V is a so-called non-sensitive region, that is, the color density is 0% transmittance (black representation) without regard to voltage values applied.

With the curve A shown in FIG. 6 (input grayscale-applied voltage curve for the first field), the applied voltage is increased monotonously for the grayscale of the input picture signal of from 0 (8 bits)≦166 (8 bits), with the applied voltage becoming equal to and fixed at a maximum value (4V) for the grayscale of the input picture signal of from 166 (8 bits)≦255 (8 bits).

With the curve B shown in FIG. 6 (input grayscale-applied voltage curve for the second field), the applied voltage becomes equal to and fixed at a minimum value (0V) for the grayscale levels of the input picture signal of from 0 (8 bits) ≦166 (8 bits), with the applied voltage increasing monotonously for the grayscale levels of the input picture signal of from 166 (8 bits)≦255 (8 bits). As for the voltage applied to the liquid crystal in each field for the input grayscale levels, the voltage values of the respective fields are alternately applied to the liquid crystal layer and sample-held at the respective pixels for a field time duration. The sample-held voltages are changed as from the selected time point due to such effects as changes in capacitance attendant on changes in the liquid crystal director or leakage of TFTs and the liquid crystal layer. The voltage value applied to each liquid crystal in each field for each input grayscale level is set so that an effective value which takes the above effects into account will be a preset transmittance corresponding to the input grayscale level.

In the curves A, B shown in FIG. 6, either the maximum voltage is applied to the first field or the minimum voltage is applied to the second field, in all grayscale levels not lower than 0 and not larger than 255 (8 bits). That is, at least one of the fields is in the state of maximum transmittance or the state of minimum transmittance at all times.

Thus, in the picture display apparatus 10 of the present embodiment, the grayscale is expressed by the first and second fields, and the transmittance of at least one field is fixed at the smallest value (0% transmittance) or at the largest value (100% transmittance). The liquid crystal exhibits superior angle of visibility characteristics for the transmittance of 0% and for the transmittance of 100%. Thus, by setting the transmittance of one of the fields to a smallest value or to a largest value, the angle of visibility characteristics may correspondingly be improved.

Figure 7:
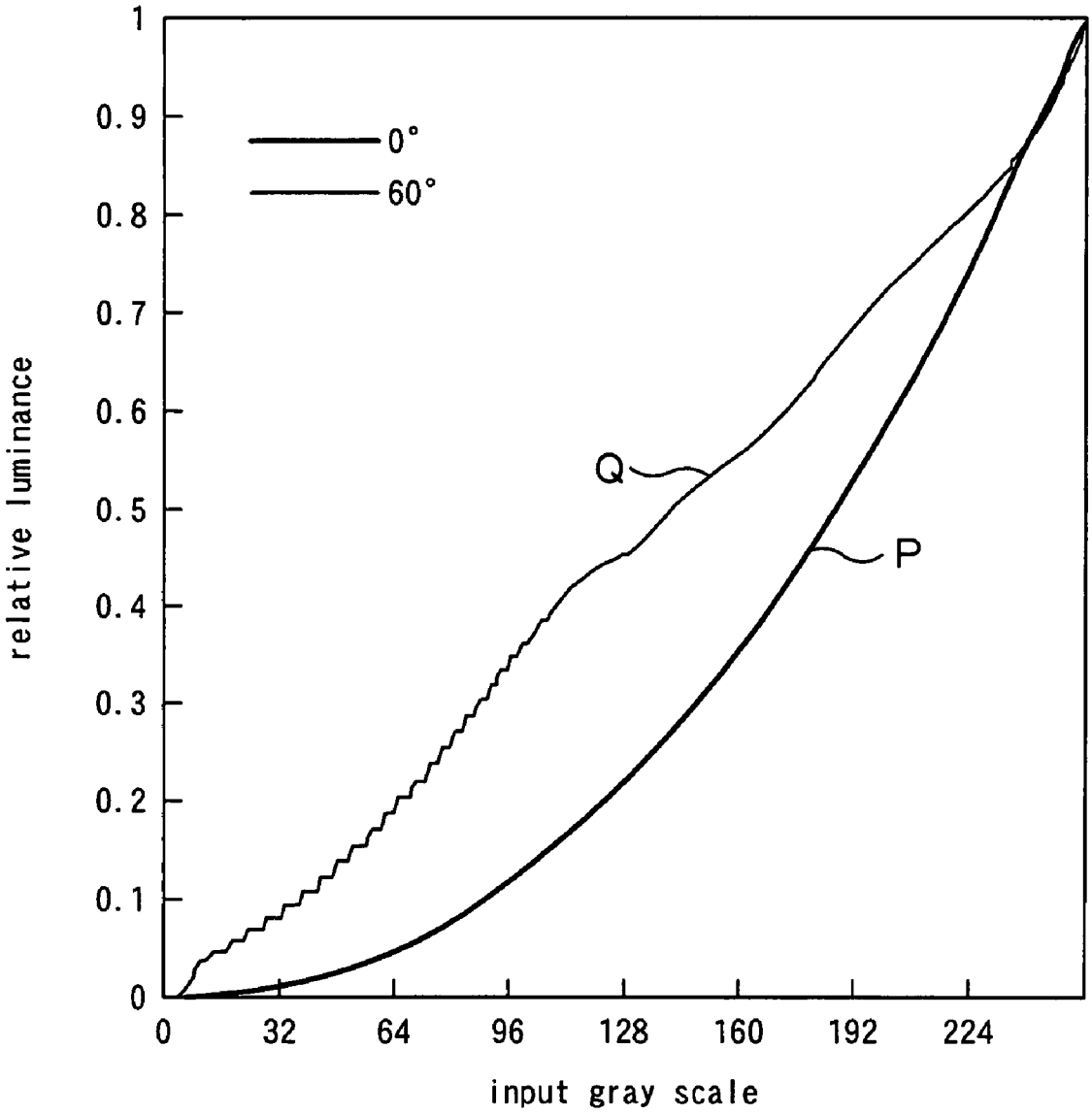
FIG. 7 is a graph showing input/output characteristics for angles of visibility of 0° and 60° of a liquid crystal panel of a picture display apparatus according to the present invention.

Specifically, FIGS. 6 and 7 show 0° angle of visibility characteristics P and 60° angle of visibility characteristics, respectively.

It is seen that the 60° angle of visibility characteristics P are improved, as apparent from comparison of this FIG. 7 to FIG. 30 for a prior-art example.

Over-Drive Processing

The over-drive processing by the over-drive unit 12 will now be described.

The over-drive processing means processing in which, in case of change from a dark picture to a light picture or from a light picture to a dark picture, in a spatial position, the liquid crystal driving voltage is slightly raised or lowered, respectively, to improve follow-up characteristics of the liquid crystal to prohibit a moving picture from becoming blurred.

If, in a conventional liquid crystal driving apparatus, a dark grayscale level is changed to a light grayscale level, a small voltage may be added to the driving voltage of the dark grayscale level side, whereby the response characteristics may approach to ideal characteristics to prohibit a moving picture from becoming blurred.

The picture display apparatus 10 according to the present invention up-converts the picture rate to a double picture rate, by the angle of visibility improvement unit 13, to express a picture, which is intrinsically a sole picture, by a first field of a light grayscale level and a second field of a dark grayscale level. It is therefore not possible to effect over-drive processing as conventionally. Hence, if the over-drive processing is to be applied to the picture display apparatus 10 according to the present invention, it is necessary to make contrivance.

Figure 8:
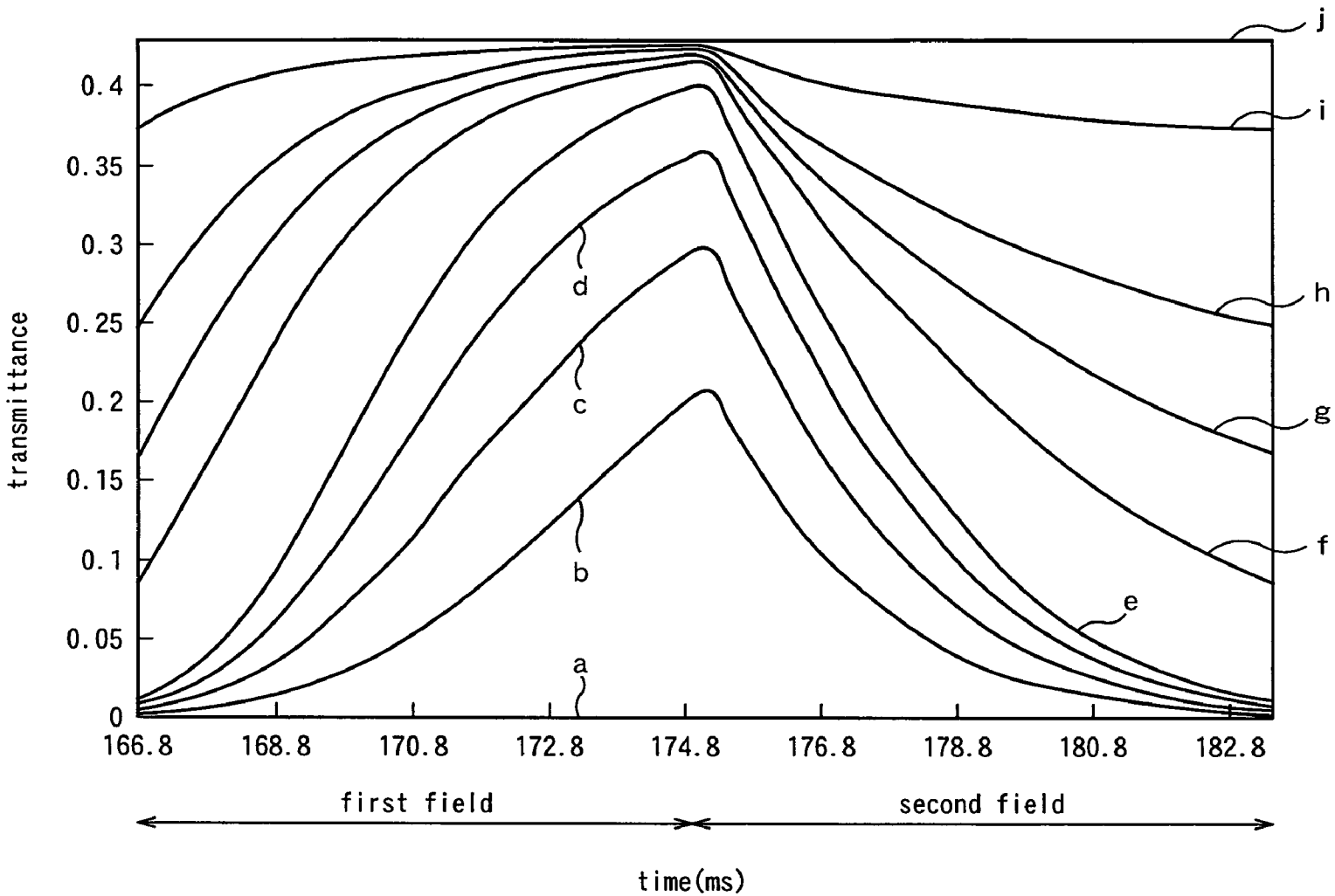
FIG. 8 is a graph showing transmittance of a liquid crystal display panel for different grayscale levels.

FIG. 8 shows time changes of transmittance of the liquid crystal in case various voltages are applied as a combination to the respective fields. Specifically, FIG. 8 shows changes in transmittance through the liquid crystal display panel 16 in case respective voltages are applied to the first and second fields.

In FIG. 8, a curve a shows changes in transmittance in case 3.0V and 0V are repeatedly applied to the first and second fields, respectively. A curve b in FIG. 8 shows changes in transmittance in case 3.4V and 0V are repeatedly applied to the first and second fields, respectively. A curve c in FIG. 8 shows changes in transmittance in case 3.6V and 0V are repeatedly applied to the first and second fields, respectively. A curve d in FIG. 8 shows changes in transmittance in case 3.8V and 0V are repeatedly applied to the first and second fields, respectively. A curve e in FIG. 8 shows changes in transmittance in case 4V and 0V are repeatedly applied to the first and second fields, respectively. A curve f in FIG. 8 shows changes in transmittance in case 4.0V and 1.9V are repeatedly applied to the first and second fields, respectively. A curve g in FIG. 8 shows changes in transmittance in case 4.0V and 2.4V are repeatedly applied to the first and second fields, respectively. A curve h in FIG. 8 shows changes in transmittance in case 4.0V and 2.8V are repeatedly applied to the first and second fields, respectively. A curve i in FIG. 8 shows changes in transmittance in case 4.0V and 3.5V are repeatedly applied to the first and second fields, respectively. A curve j in FIG. 8 shows changes in transmittance in case 4.0V and 4.0V are repeatedly applied to the first and second fields, respectively. The reason the transmittance is increased and decreased progressively in the first and second fields, respectively, is that the liquid crystal molecules of the liquid crystal display panel 16 exhibit characteristics of responding to the effective value of the applied voltage. The human eye recognizes the average value of the transmittance as luminance.

The above-described changes in transmittance, shown in FIG. 8, are ideal response characteristics in the liquid crystal display panel 16 in case there is produced no change in the grayscale level.

FIG. 9(A) and FIG. 10(A) show time changes of transmittance (T) at respective spatial positions in case the boundary line between a black picture (shown hatched) and an open picture is moved with time. Meanwhile, FIG. 9(A) shows a case where the grayscale level of an input picture signal is smaller than 166 and FIG. 10(A) shows a case where the grayscale level of an input picture signal is not smaller than 166.

FIG. 9(B) and FIG. 10(B) show characteristics of luminance of respective boundary locations (P1 to P4) in case a human eye follows the boundary between the black picture and the open picture in an effort to track a moving picture.

Figure 9:
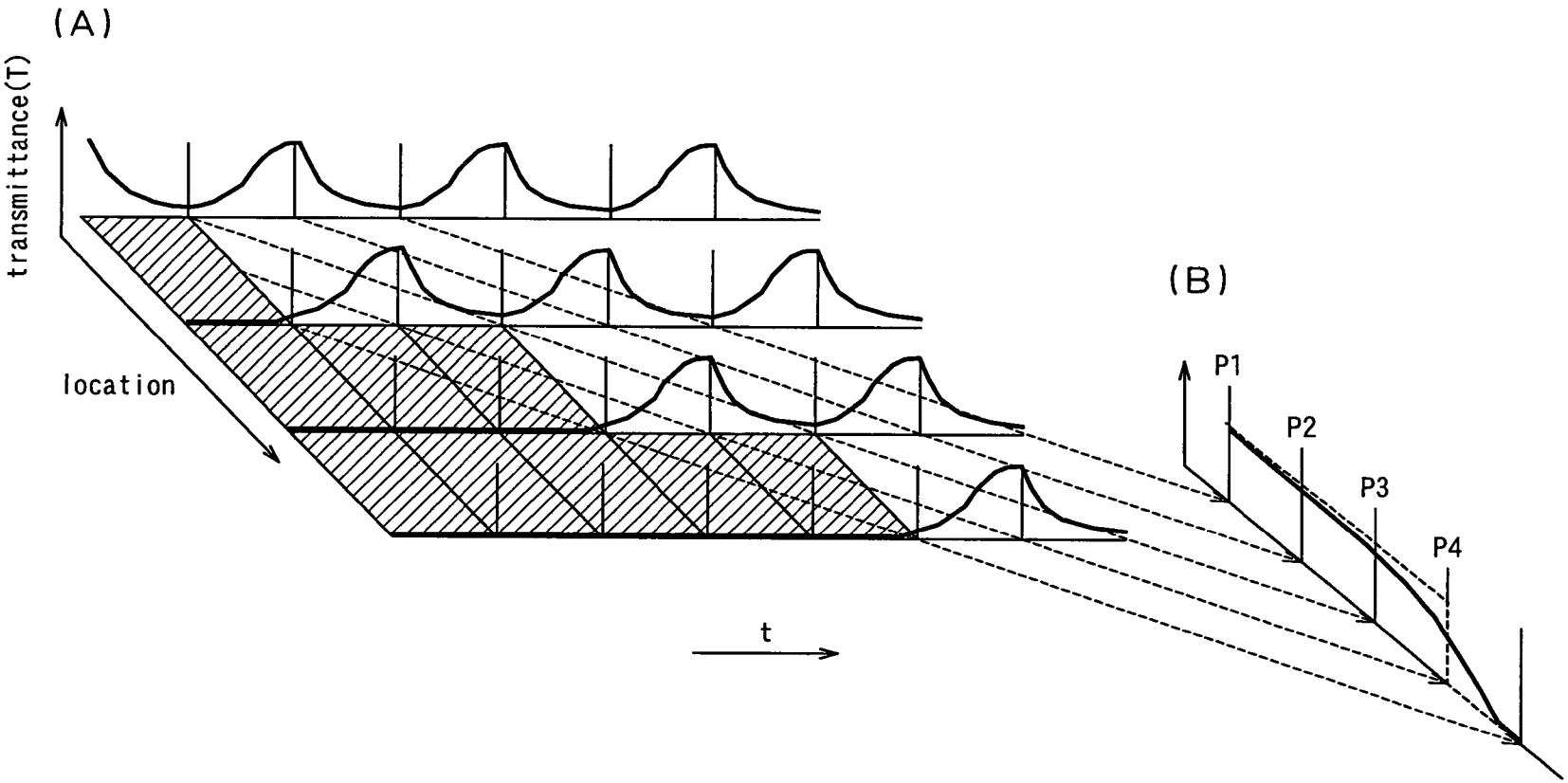
FIG. 9 shows time changes of transmittance at different spatial positions in case the boundary between black and white pictures are moved with time, with the grayscale of the input picture signal being lower than 166.
Figure 10:
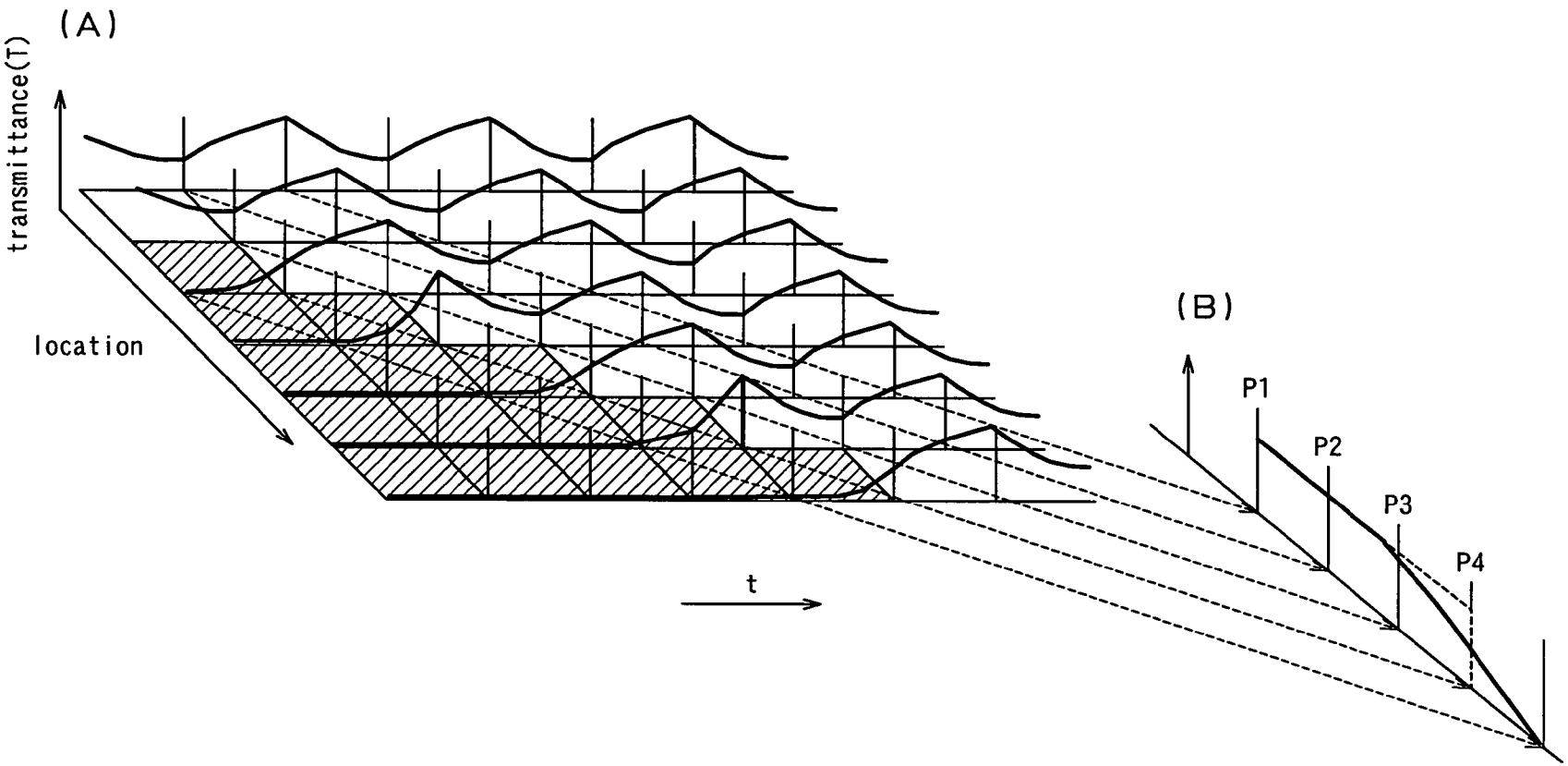
FIG. 10 shows time changes of transmittance at different spatial positions in case the boundary between black and white pictures are moved with time, with the grayscale of the input picture signal being not lower than 166.
Figure 11:
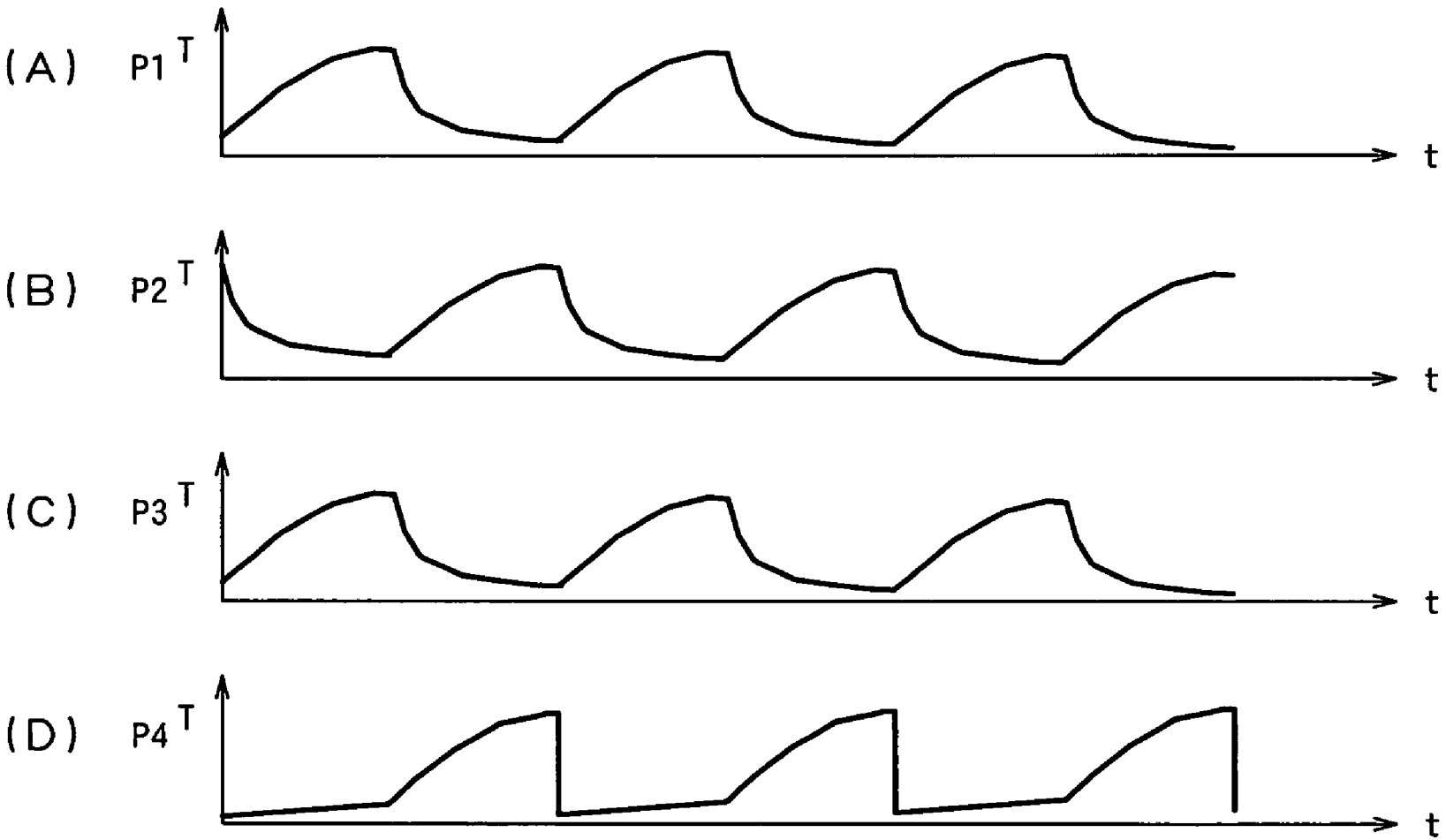
FIG. 11 shows changes in transmittance at the boundary positions P1 to P4 shown in FIG. 9.
Figure 12:
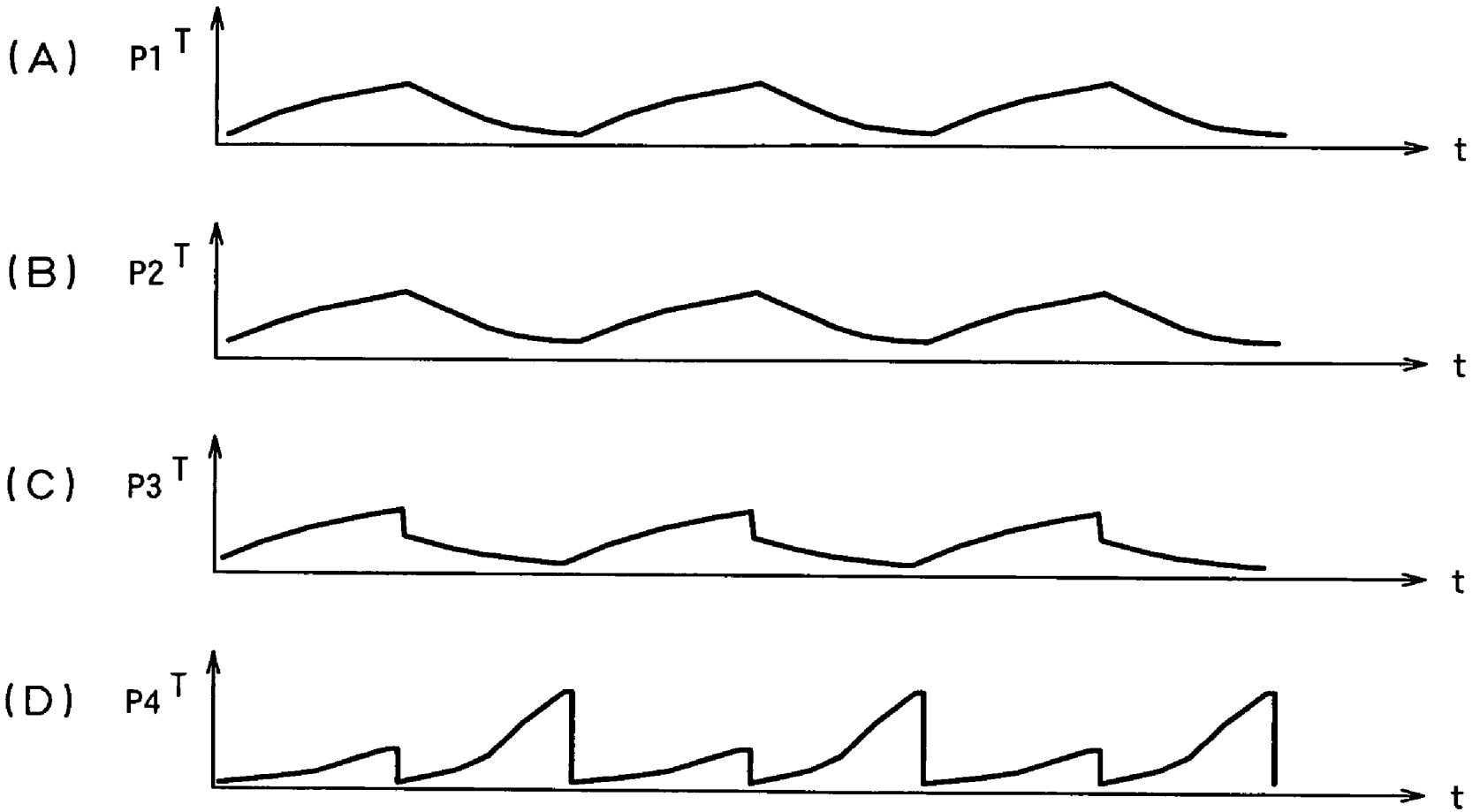
FIG. 12 shows changes in transmittance at the boundary positions P1 to P4 shown in FIG. 9.

When a user views the respective boundary locations (P1 to P4) between the black picture and the open picture as he/she follows a moving picture, he/she will recognize changes in the transmittance in the direction indicated by oblique dotted lines of FIGS. 9 and 10. FIGS. 11(A) to (D) show changes in transmittance of the positions P1 to P4, for the case shown in FIG. 9(A), and FIGS. 12(A) to (D) show changes in transmittance of the positions P1 to P4 for the case shown in FIG. 10(A).

Since the human eye recognizes the average luminance of the respective positions P1 to P4, the luminance of the positions P1 to P4 is not clear-cut, as shown by dotted lines, but is becomes dull, as shown by solid lines in FIGS. 9(B) and 10(B).

If desired to render the profile clear-cut, it suffices to correct the change in transmittance along the direction as indicated by oblique dotted lines in FIGS. 9 and 10, so that the change in transmittance will approach to transmittance characteristics for a case where no changes in grayscale are produced (see FIG. 8). That is, it suffices for the over-drive unit 12 to correct the applied voltage so that, even in case the changes in the grayscale of the input picture signal are produced, the changes in transmittance shown in FIG. 8 will be approached.

The over-drive processing, in which, in carrying out the processing for improving the angle of visibility characteristics, the ideal characteristics of the liquid crystal, shown in FIG. 8, may possibly be approached, will now be described in detail.

In the description to follow, the processing for correcting the voltage applied to the liquid crystal to the plus side (in the direction of increasing the absolute value) by driving level correction in a direction of increasing the intrinsic signal level is termed over-drive, and the quantity of the increase is termed an over-drive quantity. The processing for correcting the voltage applied to the liquid crystal to the minus side (in the direction of decreasing the absolute value) by driving level correction in a direction of decreasing the intrinsic signal level is termed under-drive, and the quantity of the decrease is termed an under-drive quantity.

Figure 13:
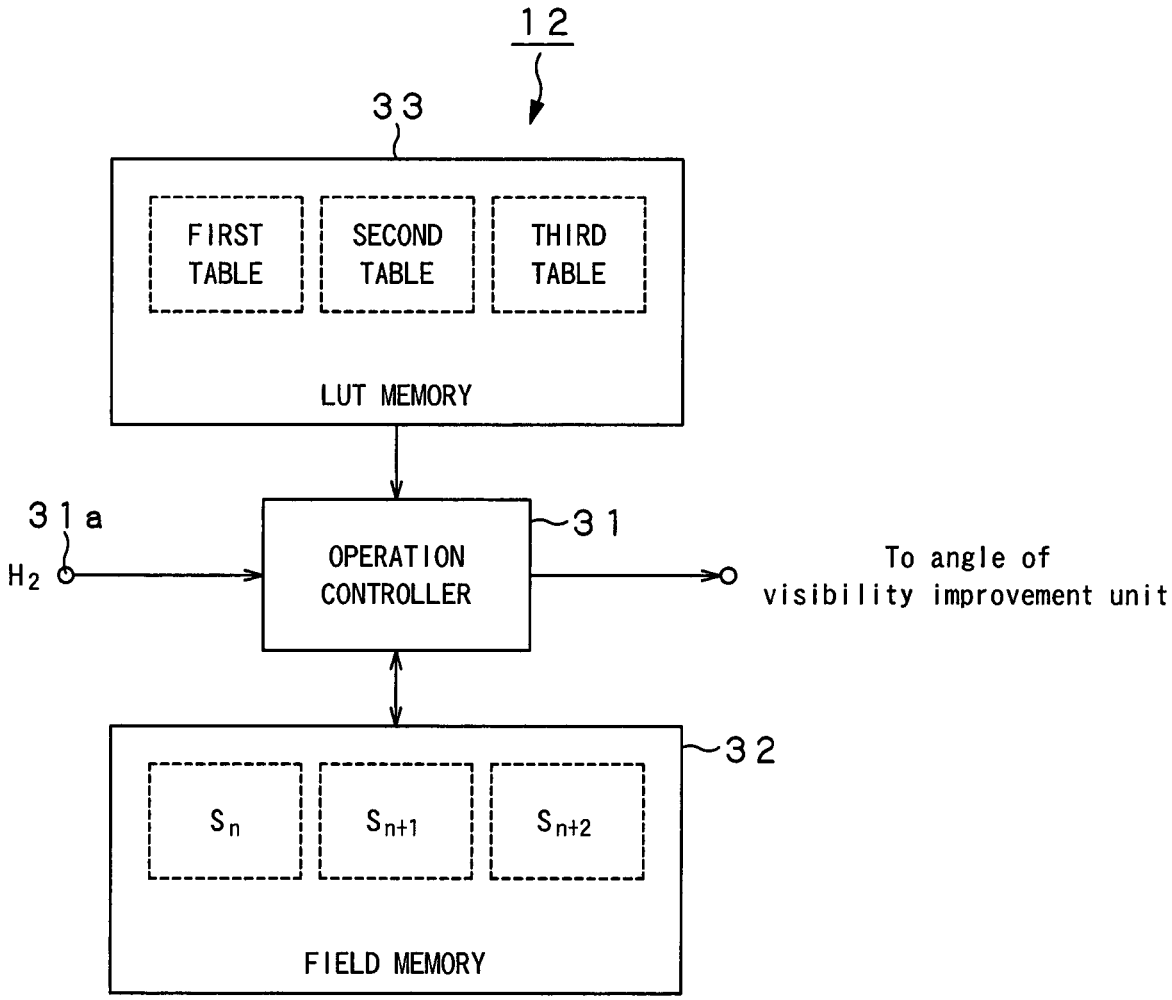
FIG. 13 is a block circuit diagram showing an example of an over-drive unit.

FIG. 13 is a block circuit diagram showing the over-drive unit 12. This over-drive unit 12 includes an operation controller 31, a field memory 32 and a lookup (LUT) memory 33.

The operation controller 31 is supplied with a 120 Hz picture signal $H_2$ via input terminal 31*a*. The operation controller 31 performs computing processing for the over-drive, while exercising input/output control of the picture signal for the field memory 32 and output control for the downstream side angle of visibility improvement unit 13. The field memory 32 has stored therein data of three consecutive fields, which data are sequentially updated at a timing of 120 Hz. Of the three consecutive fields, stored in the field memory 32, the first field is termed 'field Sn', the second field is termed 'field Sn+1' and the third field is termed 'field Sn+2'.

Meanwhile, the three field data, stored in the field memory 32, are updated every two fields, that is, every 60 Hz. Thus, the 'field Sn+2' of a previous time zone becomes the 'field Sn' in the next time zone.

In the LUT memory 33, there is stored a table in which there is stored an overdrive quantity or an under-drive quantity for addition to or subtraction from the original signal level for overdrive or under-drive, respectively. In the LUT memory 33, there are stored three tables, namely a first table, a second table and a third table.

In the first table, there is stored, for the grayscale levels for the field Sn (8 bits) and for the field Sn+2 (8 bits), an over-drive quantity or an under-drive quantity to be afforded to the field Sn+1 and the field Sn+2 as well as the field Sn+2' (field Sn used for the next time zone), as shown in FIG. 14.

In the second table, there is stored, for the grayscale levels for the field Sn (8 bits) and for the field Sn+1 (8 bits), an over-drive quantity or an under-drive quantity to be afforded to the field Sn+1 and the field Sn+2 as well as the field Sn+2' (field Sn used for the next time zone), as shown in FIG. 15.

In the third table, there is stored, for the grayscale levels for the field Sn+1 (8 bits) and for the field Sn+2 (8 bits), an over-drive quantity or an under-drive quantity to be afforded to the field Sn+1 and the field Sn+2 as well as the field Sn+2' (field Sn used for the next time zone), as shown in FIG. 16.

The over-drive quantity or the under-drive quantity, stored in the each table, but not shown in FIGS. 14 to 16, is found and set at the outset, by referring to test values, based on the response characteristics of the liquid crystal when the applied voltage is changed. In the first table, only grayscale levels for 0 to 166 (8 bits) are shown, because no reference is made to the grayscale levels in excess of 167 (8 bits).

In the over-drive unit 12, the operation controller 31 refers to the three fields, stored in the field memory 32, and reads out the signal levels of the pixels of the same spatial position in the respective fields to compare the values of the signal levels.

As a result of the comparison, one or two necessary tables are specified and the over-drive quantity or the under-drive quantity of the corresponding grayscale level stored in the so specified table(s) is read out. If necessary, the over-drive quantity or the under-drive quantity is further corrected and added to or subtracted from the signal levels of the pixels associated with the spatial position.

Over-Drive Sequence

The sequence of the over-drive processing will now be described in detail.

The over-drive unit 12 refers to signal levels in the same spatial position of the field Sn, field Sn+1 and the field Sn+2 and, based on the relative magnitudes of the signal levels, calculates in which of the fields the over-drive quantity is to be added or the under-drive quantity is to be subtracted.

Initially, it is globally determined, by way of case classification, whether the grayscale levels of all fields Sn, Sn+1 and Sn+2 are smaller than the halftone 166 (8 bits) or the grayscale level of one of the fields Sn, Sn+1 and Sn+2 is larger than the halftone 166 (8 bits).

Meanwhile, the grayscale level of 166 (8 bits) is such a level for which the voltage applied to the first field becomes maximum (with transmittance of 100%) and for which the voltage applied to the second field becomes minimum (with transmittance of 0%) (see FIG. 6 as an example).

(Case Where Sn, Sn+1, Sn+2<166)

For the grayscale level less than 166, in which the grayscale level before and after change in lightness of an input picture signal is low, 0V is applied to the second field. Hence, the picture signal of the second field does not significantly affect the combined level of the first and second fields. However, the state is similar to the so-called black insertion state and hence the response is a pulsed optical response. Thus, the state suffering only little blurring of a moving picture may be achieved.

In case of switching from the vicinity of the black level threshold to the halftone in the perpendicular orientation mode, the offset from the stationary state of the rising waveform of the optical response is smaller for a case where a voltage higher than the voltage for a stationary state (state of still picture display) is applied to the pre-change field than for a case where the voltage higher than the voltage for the stationary state is applied to the post-change field.

Figure 17:
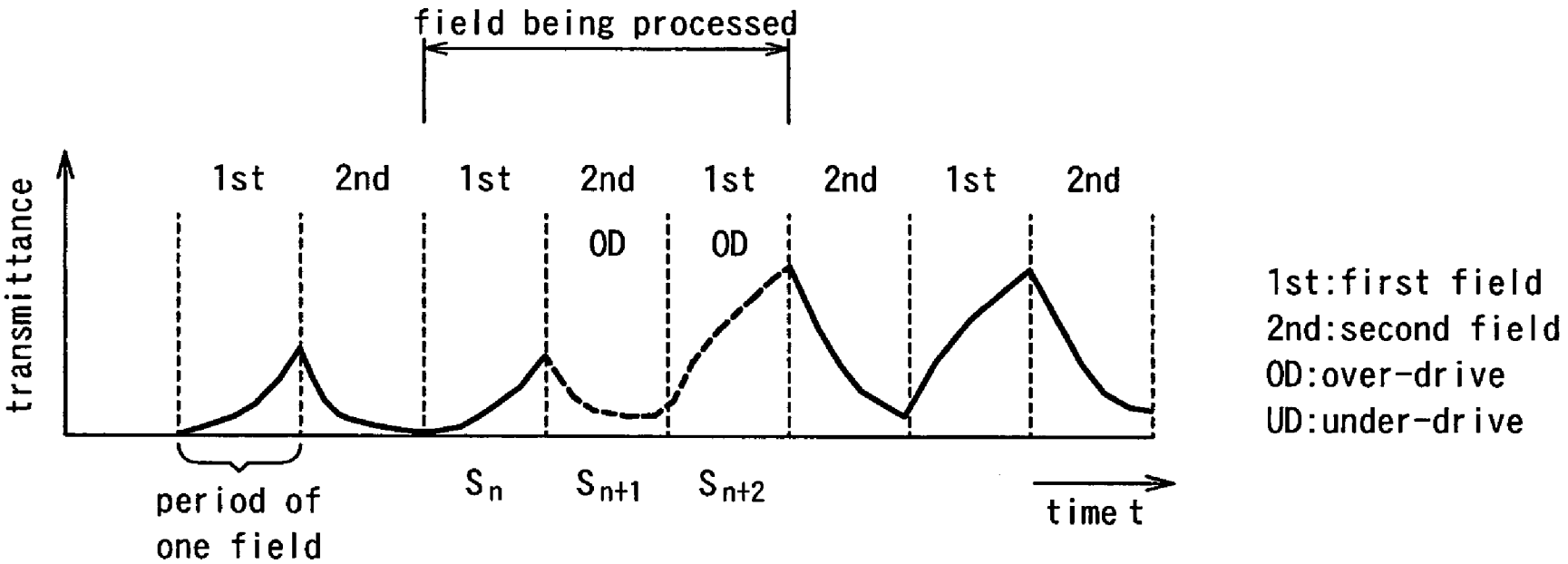
FIG. 17 shows changes in transmittance in case the grayscale of a field is lower than 166 and the input picture signal is changed over from a dark state to a light state.

Hence, if the grayscale level of each of the fields Sn, Sn+1 and Sn+2 is smaller than 166 (8 bits), and if the input picture signal is switched from the dark state (low grayscale level) to the light state (high grayscale level), a voltage equal to the inherent applied voltage plus an over-drive voltage is applied to Sn+1 (second field), as shown in FIG. 17.

However, if, in this case, the above voltage is applied only to the second field, the rising waveform of the optical response is deviated from the stationary state, under the effect of back-follow of the liquid crystal, and blurring tends to be produced before switching. Thus, the voltage corresponding to the inherent applied voltage plus a suitable over-drive value is applied to the post-change Sn+2 (first field).

Figure 18:
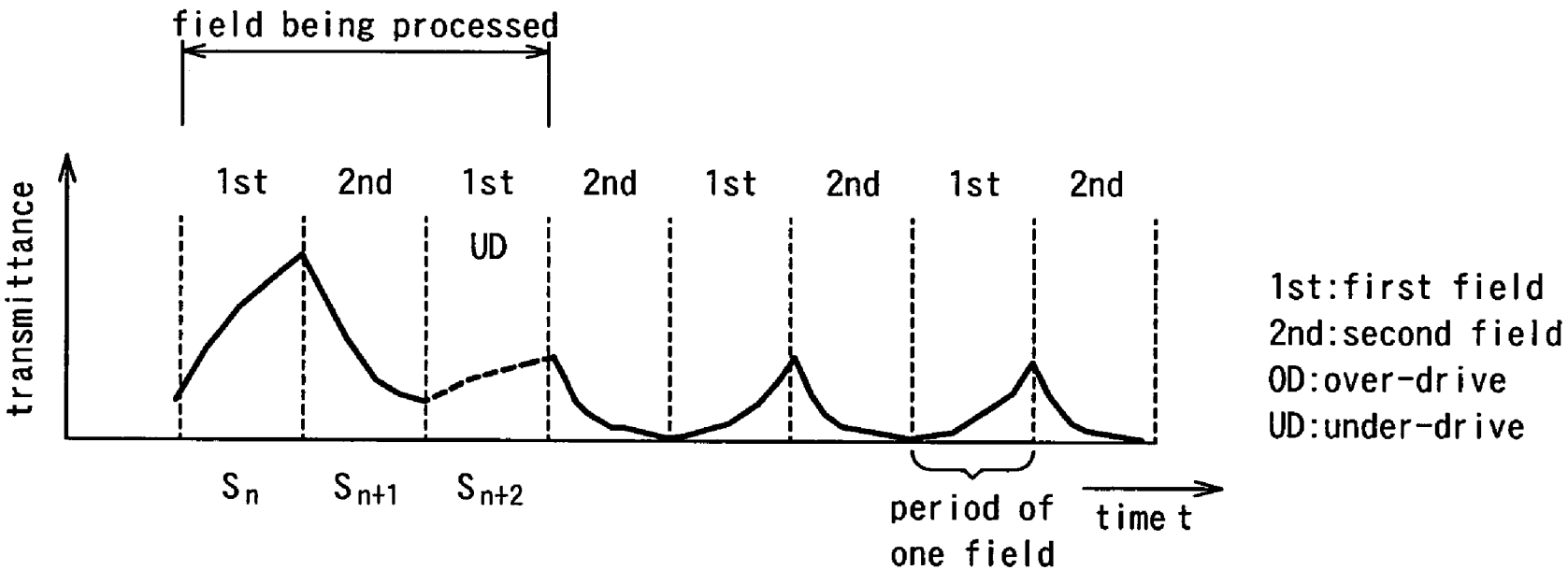
FIG. 18 shows changes in transmittance in case the grayscale of a field is lower than 166 and the input picture signal is changed over from a light state to a dark state.

Moreover, if the grayscale level is lower in all fields Sn, Sn+1 and Sn+2 than 166 (8 bits), as shown in FIG. 18, and the input picture signal is switched from the light state (high grayscale level) to the dark state (low grayscale level), a voltage corresponding to the inherent applied voltage less an under-drive voltage is applied to the post-change Sn+2 (first field).

The over-drive value and the under-drive value for the case where the gray sale levels of all fields, that is, Sn, Sn+1 and Sn+2, are smaller than 166 (8 bits), are computed by the operation controller 31 referring to the first table. In addition, data for the field Sn+2' of the first table are used if necessary as an over-drive quantity for the field Sn used during the next time zone.

(Case Where One of Sn, Sn+1 and Sn+2≧166)

The case where the grayscale level of one of consecutive Sn, Sn+1 and Sn+2 is not smaller than the aforementioned halftone 166 (8 bits) will now be described.

In case the grayscale level is not less than 166, an over-drive sequence is separately determined for each of the four cases, that is, a case where the grayscale is monotonously increased in the sequence of Sn, Sn+1 and Sn+2, a case where the grayscale is monotonously decreased in the sequence of Sn, Sn+1 and Sn+2, a case where Sn+1 is high in grayscale level among the three fields, and a case where Sn+1 is low in grayscale level among the three fields.

<Case Where the Grayscale is Monotonously Increased in the Sequence of Sn, Sn+1 and Sn+2>

Figure 19:
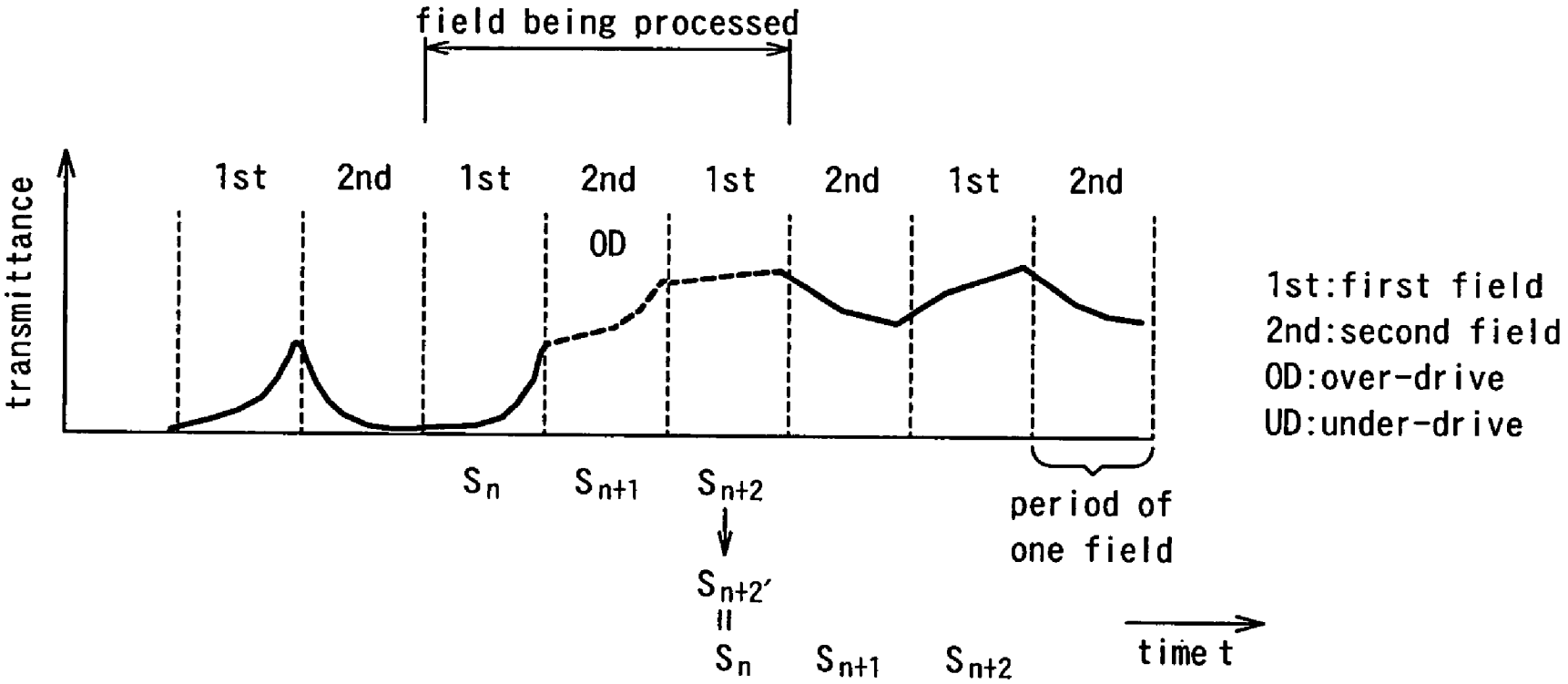
FIG. 19 shows a first example of changes in transmittance in case the grayscale of a field is lower than 166 and the grayscale is increased monotonously.
Figure 20:
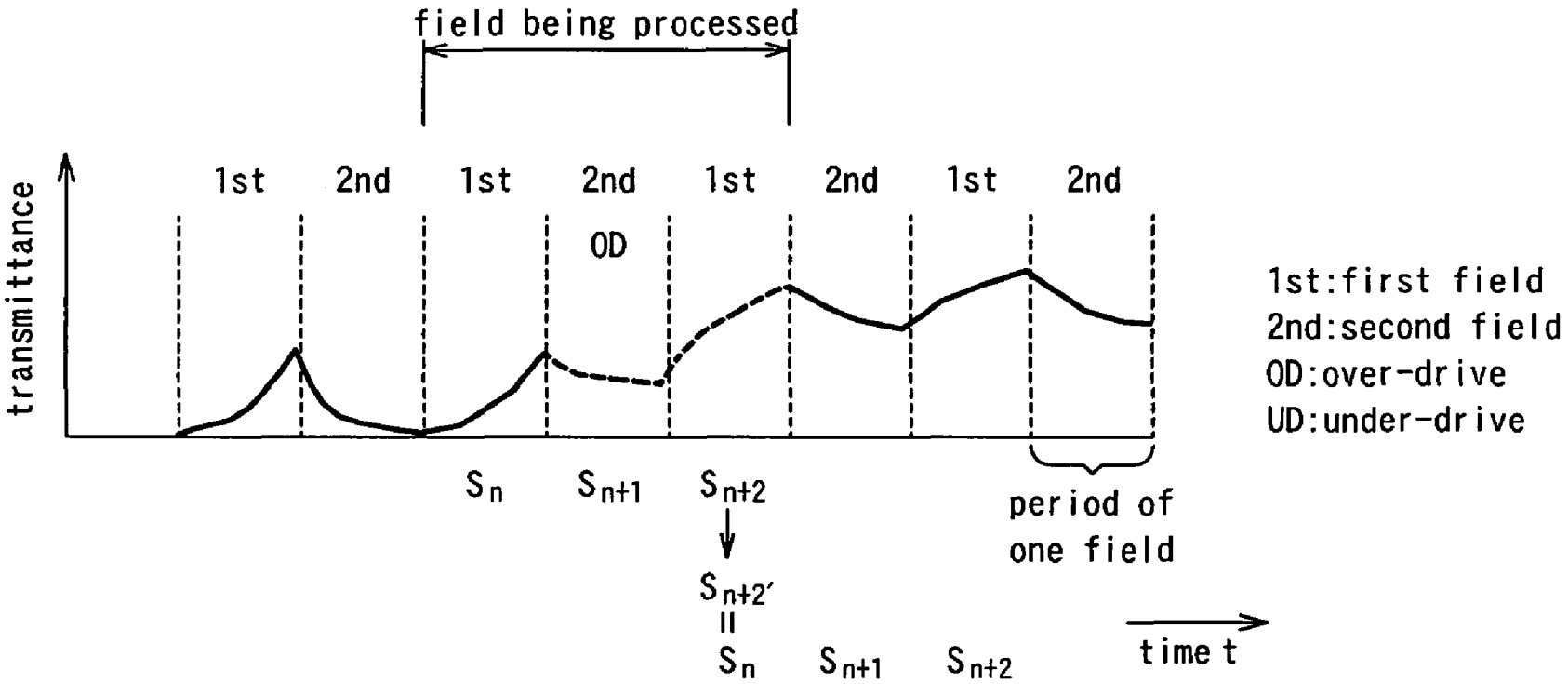
FIG. 20 shows a second example of changes in transmittance in case the grayscale of a field is lower than 166 and the grayscale is increased monotonously.

In case the grayscale level is monotonously increased in the sequence of Sn, Sn+1 and Sn+2, an over-drive is applied to Sn+1, as shown in FIGS. 19 and 20.

The reason is that Sn+2 has the maximum value of the grayscale level, so that, if γ of the first field is applied to Sn+2, the maximum voltage is applied to the liquid crystal, and hence there is possibly no allowance for adding the over-drive quantity.

The over-drive quantity for Sn+1 is found by the following method.

In the second table, an over-drive quantity for Sn<(Sn+1=Sn+2) is stored. In the third table, an over-drive quantity for (Sn=Sn+1)<Sn+2 is stored.

The value that may be taken on by Sn+1 is intermediate between these two conditions. Hence, the optimum over-drive quantity is also a value intermediate between these two values. Thus, if the grayscale level is monotonously increased in the sequence of Sn, Sn+1 and Sn+2, the over-drive quantity is found by interpolating the values of the second and third tables.

For example, the operation controller 31 calculates an over-drive quantity OD of the fields Sn+1 and Sn+2, in accordance with the following equation (1):

$$OD=[OD2*(Sn+1-Sn)+OD*(Sn+2-Sn+1)]/(Sn+2-Sn) \quad (1)$$

where OD2 is the over-drive quantity stated in the second table and OD3 is the over-drive quantity stated in the third table.

The equation is computed by linear interpolation. However, this method for interpolation is not restrictive.

Meanwhile, if over-drive is applied to Sn+1, there may be cases where the post-change state is not up to the stationary state, due to e.g. constraints of the power supply voltage of the source driver. In such case, the over-drive or under-drive quantity, applied to the next field, may be deviated from an optimum value. Hence, for possibly avoiding this deviation, the operation controller 31 computes a predicted value of the picture signal which has reflected the director state of the liquid crystal, as predicted as the consequence of applying the over-drive, and sends the so computed field data to the field memory 32 as a computed quantity for the next time zone.

That is, data of the field Sn+2 is corrected to compute Sn+2' and the so computed Sn+2' is set as data of Sn used in the next time zone, as shown in FIGS. 19 and 20. Sn+2' may be computed by, for example, the next equation (2):

$$Sn+2'=[Sn+2'(\text{table2})*(Sn+1-Sn)+Sn+2'(\text{table3})*(Sn+2-Sn+1)]/(Sn+2-Sn) \quad (2)$$

where Sn+2' (table2) is data of the column of Sn+2' of the second table and Sn+2' (table3) is data of the column of Sn+2' of the third table.

<Case Where the Grayscale is Monotonously Decreased in the Sequence of Sn, Sn+1 and Sn+2>

Figure 21:
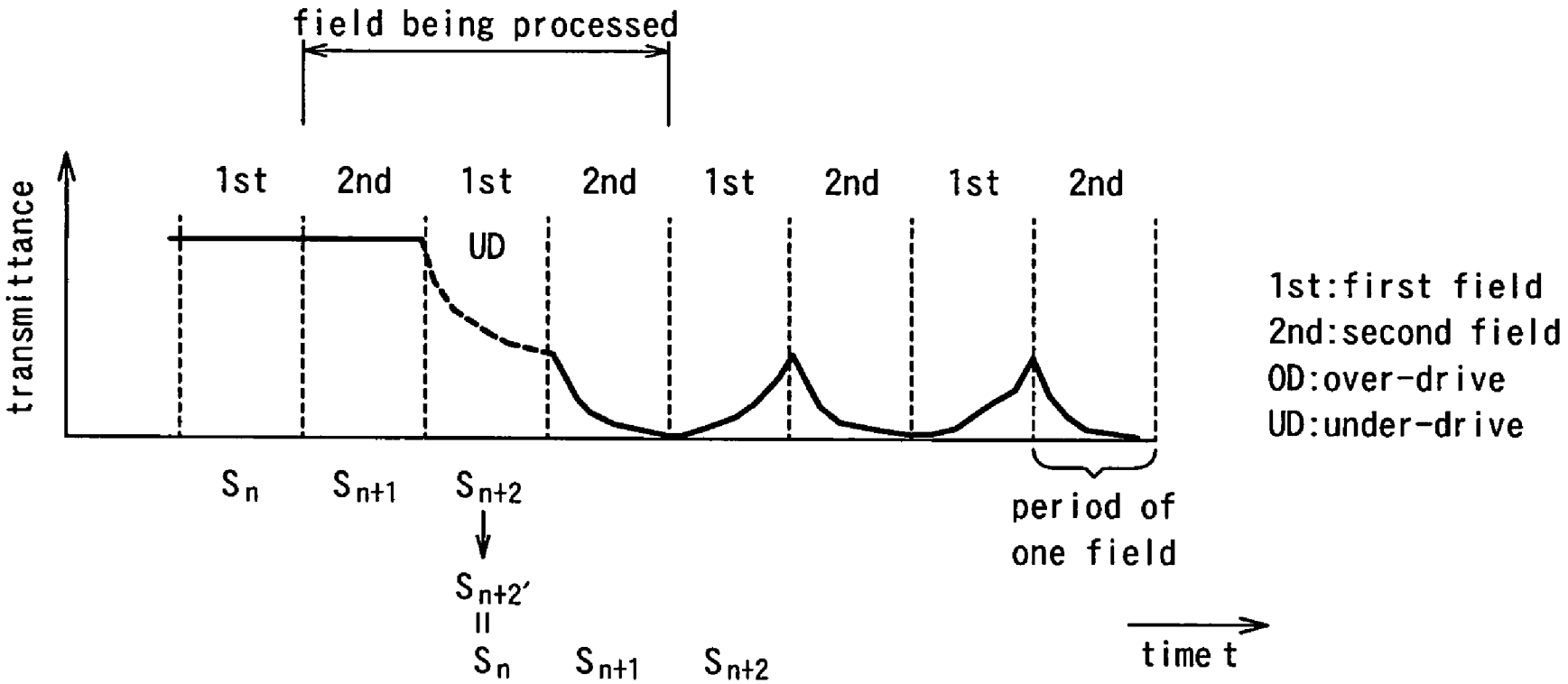
FIG. 21 shows a first example of changes in transmittance in case the grayscale of a field is lower than 166 and the grayscale is decreased monotonously.
Figure 22:
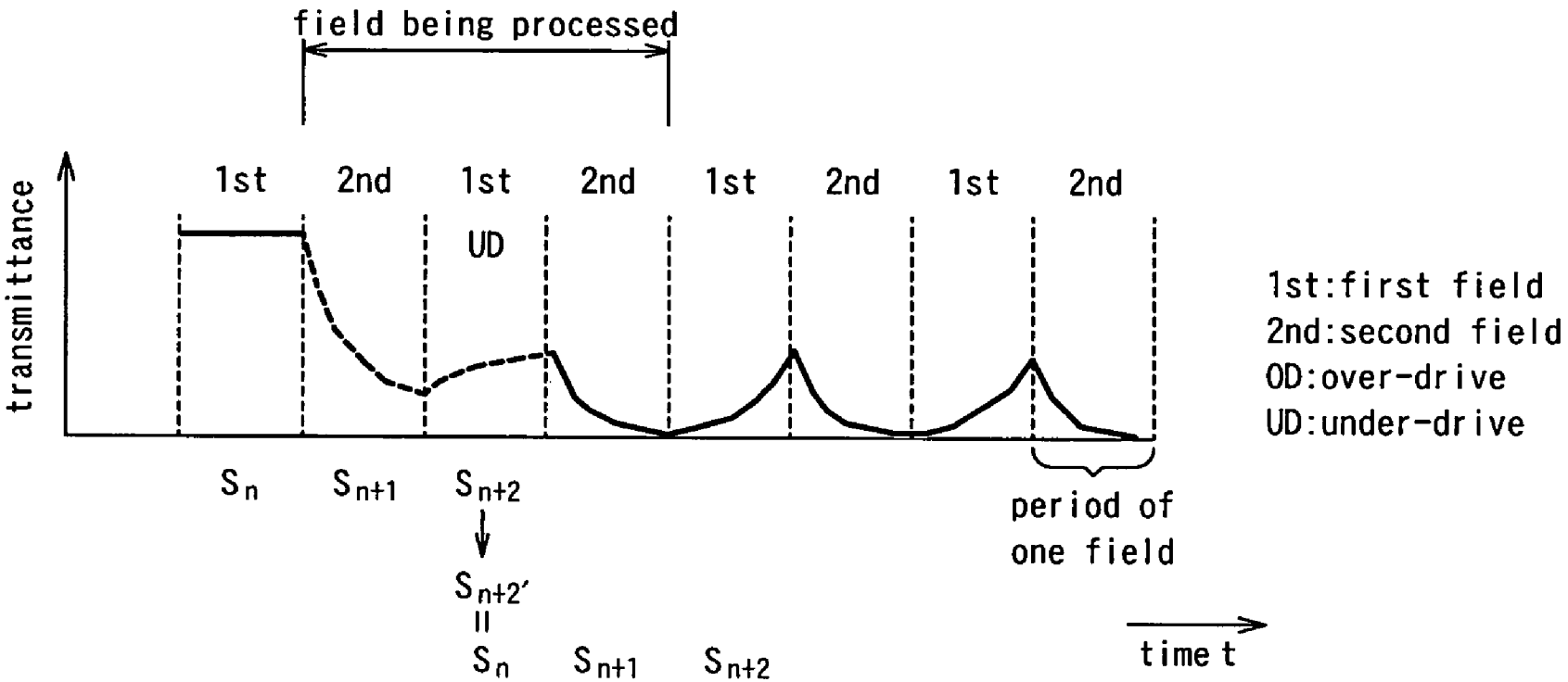
FIG. 22 shows a second example of changes in transmittance in case the grayscale of a field is lower than 166 and the grayscale is decreased monotonously.
Figure 23:
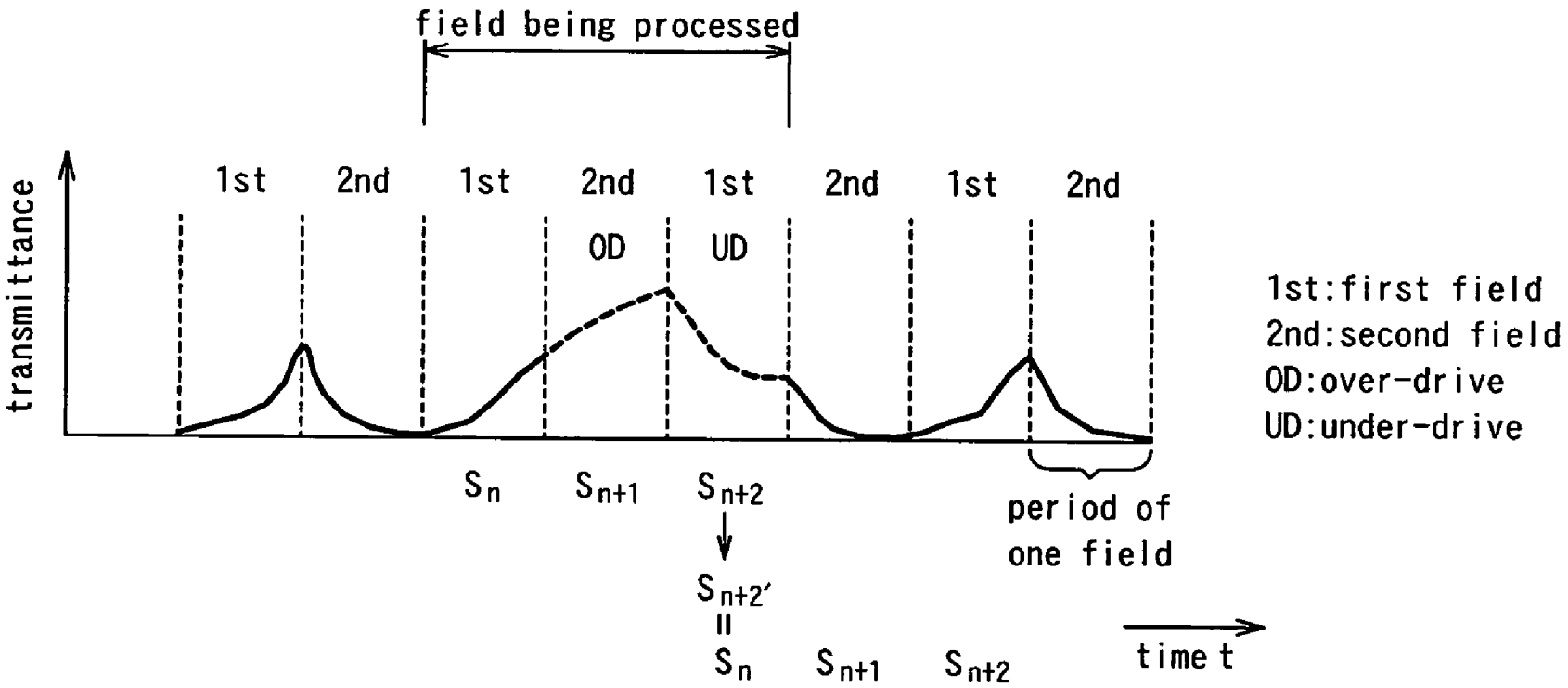
FIG. 23 shows changes in transmittance in case the grayscale of a field is not lower than 166 and in case Sn+1 is high in grayscale level among three fields.
Figure 24:
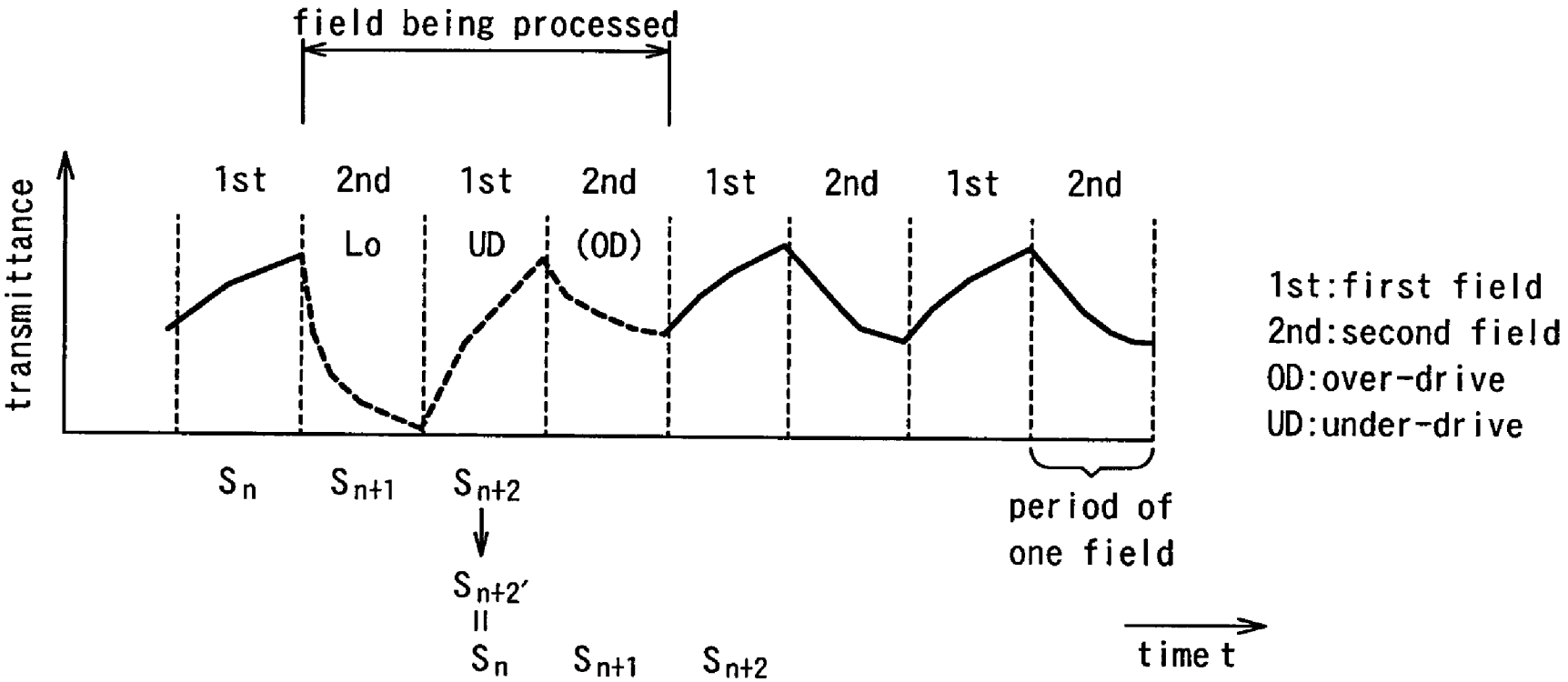
FIG. 24 shows changes in transmittance in case the grayscale of a field is not lower than 166 and in case Sn+1 is low in grayscale level among three fields.

In case the grayscale level is decreased monotonously in the sequence of Sn, Sn+1 and Sn+2, an under-drive is applied to Sn+2, as shown in FIGS. 21 and 22.

The under-drive quantity for Sn+2 is found by the following method.

In the second table, an under-drive quantity for Sn>(Sn+1=Sn+2) is stored. In the third table, an under-drive quantity for (Sn=Sn+1)>Sn+2 is stored.

The value that may be taken on by Sn+2 is intermediate between these two conditions. Hence, the optimum under-drive quantity is also a value intermediate between these two values. Thus, if the grayscale level is monotonously decreased in the sequence of Sn; Sn+1 and Sn+2, the under-drive quantity is found by interpolating the values of the second and third tables.

For example, the operation controller 31 calculates an under-drive quantity UD of the fields Sn+1 and Sn+2, in accordance with the following equation (3):

$$UD=[UD2*(Sn-Sn+1)+UD3*(Sn+1-Sn+2)]/(Sn-Sn+2) \quad (3)$$

where UD2 is the under-drive quantity stated in the third table and UD3 is the under-drive quantity stated in the third table.

The equation (3) is computed by linear interpolation. However, this method for interpolation is given only by way of illustration and is not to be restrictive.

Meanwhile, if under-drive is applied to Sn+2, there may be cases where the post-change state is not up to the stationary state, because the voltage value applied to the liquid crystal cannot be made less than 0V. In such case, the over-drive or under-drive quantity, applied to the next field, may become offset from an optimum value. Hence, for possibly avoiding the offset, the operation controller 31 computes a predicted value of the picture signal which has reflected the director state of the liquid crystal, as predicted as the consequence of applying the over-drive, and sends the so computed field data to the field memory 32 as a computed quantity for the next time zone.

That is, data of the field Sn+2 is corrected to compute Sn+2' and the so computed Sn+2' is set as data of Sn used in the next time zone, as shown in FIGS. 21 and 22. Sn+2' may be computed by, for example, the next equation (4):

$$Sn+2'=[Sn+2'(\text{table2})*(Sn-Sn+1)+Sn+2'(\text{table3})*(Sn+1-Sn+2)]/(Sn-Sn+2) \quad (4)$$

<Case Where Sn+1 is High Among the Three Fields>

In case the grayscale level of Sn+1 is high among the grayscale levels of the three fields, an over-drive is first applied to Sn+1, and under-drive is then applied to Sn+2.

The over-drive quantity for Sn+1 is computed by having reference to the second table. The under-drive quantity for Sn+2 is computed by having reference to the third table.

There is a possibility that the voltage applied to Sn+1 after adding the over-drive quantity is not up to the stationary value. In this consideration, a predicted value Sn+1', which takes into account the fact that the voltage applied to Sn+1 after adding the over-drive quantity is not up to the stationary value is computed by having reference to the second table, and the predicted value Sn+1' is substituted for Sn+1 used for determining an under-drive quantity for the next Sn+2.

Moreover, the operation controller 31 computes a predicted value of the picture signal, which has reflected the state of the director of the liquid crystal, as predicted as the consequence of applying the under-drive, and sends the so computed field data to the field memory 32 as a computed quantity for the next time zone. That is, data of the field Sn+2 is corrected by referring to the third table to compute Sn+2', and the so computed Sn+2' is used as data of Sn for the next time zone.

<Case Where Sn+1 is Low Among Three Fields>

In case Sn+1 is low among the three fields, under-drive is applied to Sn+2. In addition, over-drive may further be applied to the field next following Sn+2.

In the second table, there is stored an under-drive quantity for the case of Sn>(Sn+1=Sn+2). Sn+1 is fixed at a maximum value.

The value that may be taken on by Sn+2 is intermediate between these two conditions. Hence, the optimum under-drive quantity is also a value intermediate between these two conditions. Thus, if Sn+1 is low among the three fields, the under-drive quantity is found by interpolation of the value of the second table and the maximum possible voltage that may be applied (Hi).

For example, the operation controller 31 computes the under-drive quantity UD in accordance with the following equation (5):

$$UD=[UD2*(Sn-Sn+1)+Sn+2(Hi)*(Sn+2-Sn+1)]/(Sn+2+Sn-2*Sn+1)] \quad (5)$$

Moreover, the operation controller 31 computes a predicted value of the picture signal, which has reflected the state of the director of the liquid crystal, as predicted as the consequence of applying the under-drive, and sends the so computed field data to the field memory 32 as a computed quantity for the next time zone. That is, data of the field Sn+2 is corrected to compute Sn+2', and the so computed Sn+2' is used as data of Sn for the next time zone.

That is, the data of the field Sn+2 is corrected to compute Sn+2', and the so computed Sn+2' is set as data of Sn used for the next time zone. This Sn+2' may be computed by, for example, the following equation (6):

$$Sn+2'=[Sn+2'(\text{table2})*(Sn+1-Sn)+Sn+2'(\text{table3})*(Sn+2-Sn+1)]/(Sn+2+Sn-2*Sn+1) \quad (6)$$

<Processing Flow>

Figure 25:
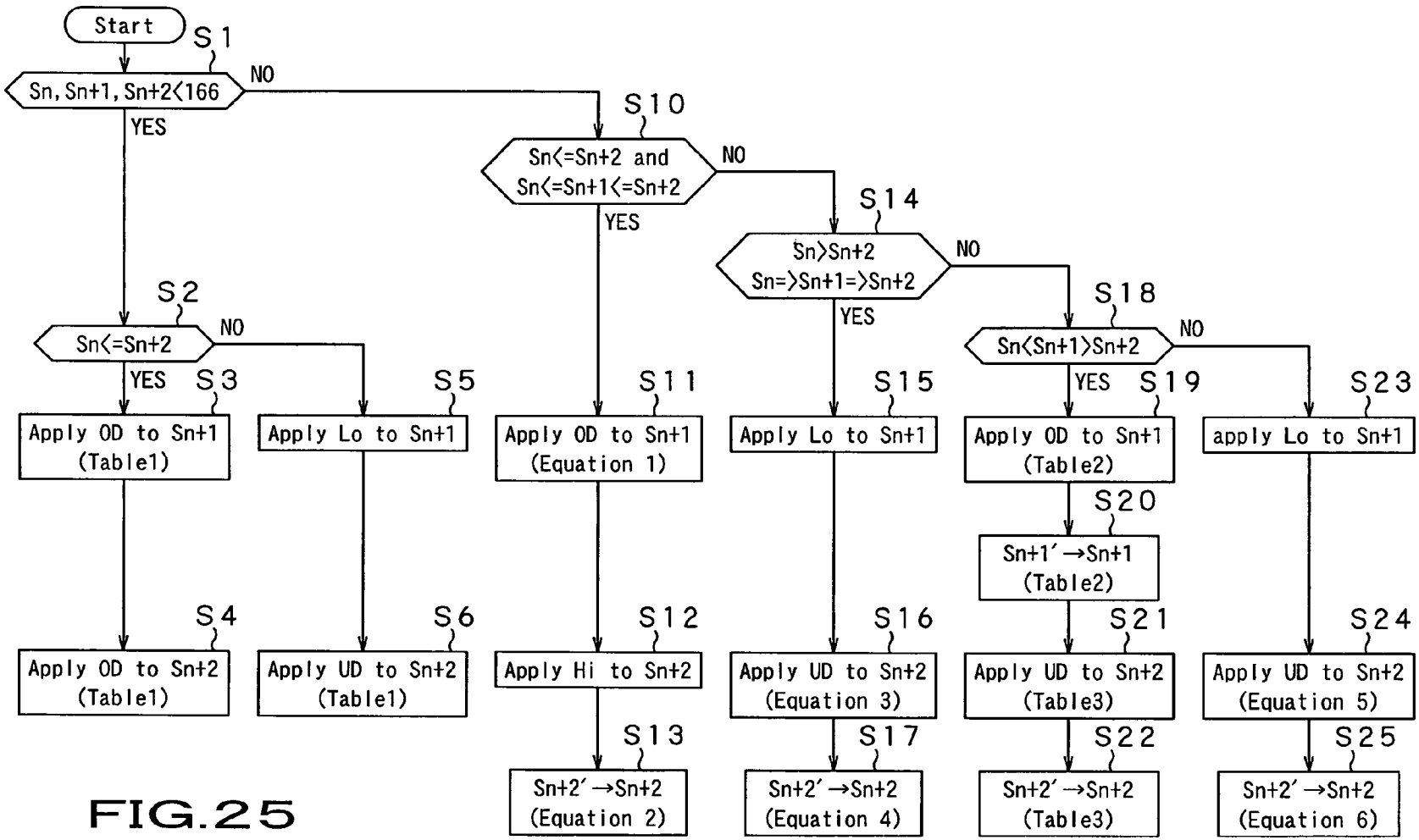
FIG. 25 is a flowchart showing the sequence of an over-drive and an under-drive.

A processing flow, conforming to the above-described sequence of the over-drive processing, is shown in FIG. 25.

First, the operation controller 31 in step S1 verifies whether the grayscale levels of all fields Sn, Sn+1 and Sn+2 are smaller than the halftone 166 (8 bits). If the result is affirmative, processing transfers to a step S2 and, if otherwise, processing transfers to a step S10.

In the step S2, the operation controller 31 verifies whether or not Sn≦Sn+2. That is, the operation controller 31 verifies whether or not the dark grayscale level has been changed over to the light grayscale level.

When the dark grayscale level has been switched to the light grayscale level, processing transfers to a step S3 where the operation controller 31 refers to the first table to apply over-drive to Sn+1. Then, in a step S4, the operation controller refers to the first table to apply over-drive to Sn+2 to finish the processing.

In case a dark grayscale level has been changed over to a light grayscale level, processing transfers to a step S5, where the operation controller 31 sets Sn+1 to low driving (driving at the minimum voltage). Then, in a step S6, the operation controller refers to the first table to apply an under-drive to Sn+2 to finish the processing.

If it is determined in the step S1 that the grayscale levels of all fields Sn, Sn+1, Sn+2 are higher than the halftone 166 (8 bits), processing transfers to a step S10, where the operation controller 31 verifies whether or not Sn≦Sn+2 and Sn≦Sn+1≦Sn+2, that is, whether or not the grayscale level is increasing monotonously. If the grayscale level is increasing monotonously, processing transfers to a step S11 and, if otherwise, processing transfers to a step S14.

In the step S11, the operation controller 31 refers to the above equation (1) to apply an over-drive to Sn+1. Then, in a step S12, the operation controller sets Sn+2 to high driving (driving at the maximum voltage). Then, in a step S13, the operation controller refers to the equation (S2) to correct the value of Sn+2 to finish the processing.

If it has been determined in the step S10 that the grayscale level is not increasing monotonously, processing transfers to a step S14. In this step S14, the operation controller 31 verifies whether or not Sn>Sn+2 and Sn≧Sn+1≧Sn+2, that is, whether or not the grayscale level is decreasing monotonously. If the grayscale level is decreasing monotonously, processing transfers to a step S15 and, if otherwise, processing transfers to a step S18.

In the step S15, the operation controller 31 sets Sn+1 to low driving (driving at the minimum voltage). Then, at a step S16, the operation controller refers to the above equation (3) to apply an under-drive to Sn+2. Then, in a step S17, the operation controller refers to the above equation (4) to correct the value of Sn+2 to finish the processing.

If it has been determined in the step S14 that the grayscale level is not decreasing monotonously, processing transfers to a step S18. In this step S18, the operation controller 31 verifies whether or not (Sn<Sn+1>Sn+2, that is, whether or not Sn+1 is largest. If Sn+1 is largest, processing transfers to a step S19 and, if otherwise, processing transfers to a step S23.

In the step S19, the operation controller 31 refers to the second table to apply an over-drive to Sn+1. Then, in a step S20, the operation controller 31 refers to the second table to correct the value of Sn+1 and, in a step S21, the operation controller refers to the third table to apply an under-drive to Sn+2. Then, in a step S22, the operation controller refers to the third table to correct the value of Sn+2 to finish the processing.

In a step S23, the operation controller 31 sets Sn+1 to low driving (driving at the minimum voltage). Then, in a step S24, the operation controller refers to the equation (5) to apply an under-driving to Sn+2. Then, in a step S25, the operation controller refers to the aforementioned equation (6) to correct the value of Sn+2 to finish the processing.

In the above configuration, picture signals of consecutive frames are stored in a plural number of frame memories, to which reference is made to determine an optimum over-drive quantity for a field where a positive value for correction is added to the grayscale level of the input picture signal by way of converting the transmittance (field 1) or for a field where a negative value for correction is added to the grayscale level of the input picture signal by way of converting the transmittance (field 2). However, the above configuration is given only by way of illustration and is not intended for restricting the invention. Thus, it is also possible to find corresponding past and future pixels in the same frame, from the moving vectors of respective pixels, and to calculate the optimum over-drive quantity from the pixel information, in place of storing past and future picture signals in the frame memories.

Also, gamma characteristics of an output for input data differ in general for each of the colors red (R), green (G) and blue (B). A configuration of having reference to tables of respective colors R, G and B, a configuration of having reference to an over-drive table following the conversion at the outset to data having corrected gamma characteristics of R, G and B colors, or a configuration of correcting gamma characteristics of R, G and B colors in a gamma converter, is possible. Moreover, if an optimum over-drive is configured for being applied to the correction levels of the fields 1 and 2, output from the angle of visibility improvement unit 13, it is possible to correct the signal level supplied to the angle of visibility improvement unit 13 and to apply the desired over-drive to an resultantly converted output, while it is also possible not to correct the level of the signal supplied to the angle of visibility improvement unit 13 but to convert the signal to the correction levels of the fields 1 and 2 in the angle of visibility improvement unit 13 and thereafter to convert the level of the output so that the desired over-drive will be applied depending on an input signal.

Other Embodiment

Another embodiment of the present invention will now be described.

Figure 26:
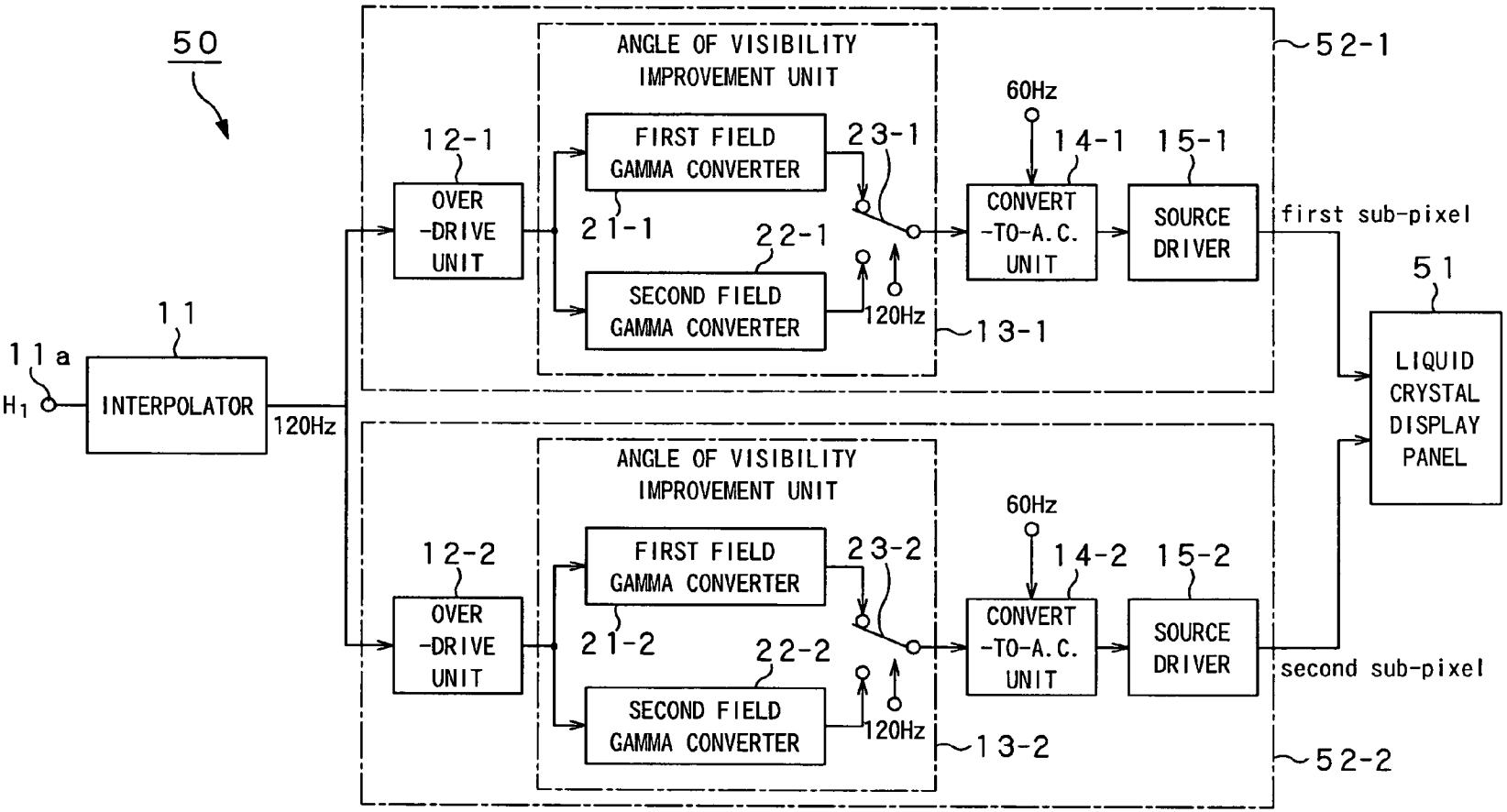
FIG. 26 is a block circuit diagram showing a second embodiment of the picture display apparatus according to the present invention.

FIG. 26 depicts a block circuit diagram showing another embodiment of a liquid crystal display apparatus 50 according to the present invention. It is noted that parts or components having the same functions as the parts of components used in the above-described liquid crystal display apparatus 10 are denoted by the same reference numerals, added or not added with branch numbers, and detailed description is dispensed with.

Referring to FIG. 26, the liquid crystal display apparatus 50 includes a liquid crystal display panel 51, an interpolator 11, a first sub-pixel processor 52-1 and a second sub-pixel processor 52-2.

The liquid crystal display panel 51 exploits a so-called effective value response type liquid crystal of a twisted nematic mode, employing the nematic liquid crystal, or a perpendicular orientation mode, with a relatively slow liquid crystal response speed, in which the transmittance corresponds to the effective value (mean square) of the voltages applied to the liquid crystal in the plural fields.

Figure 27:
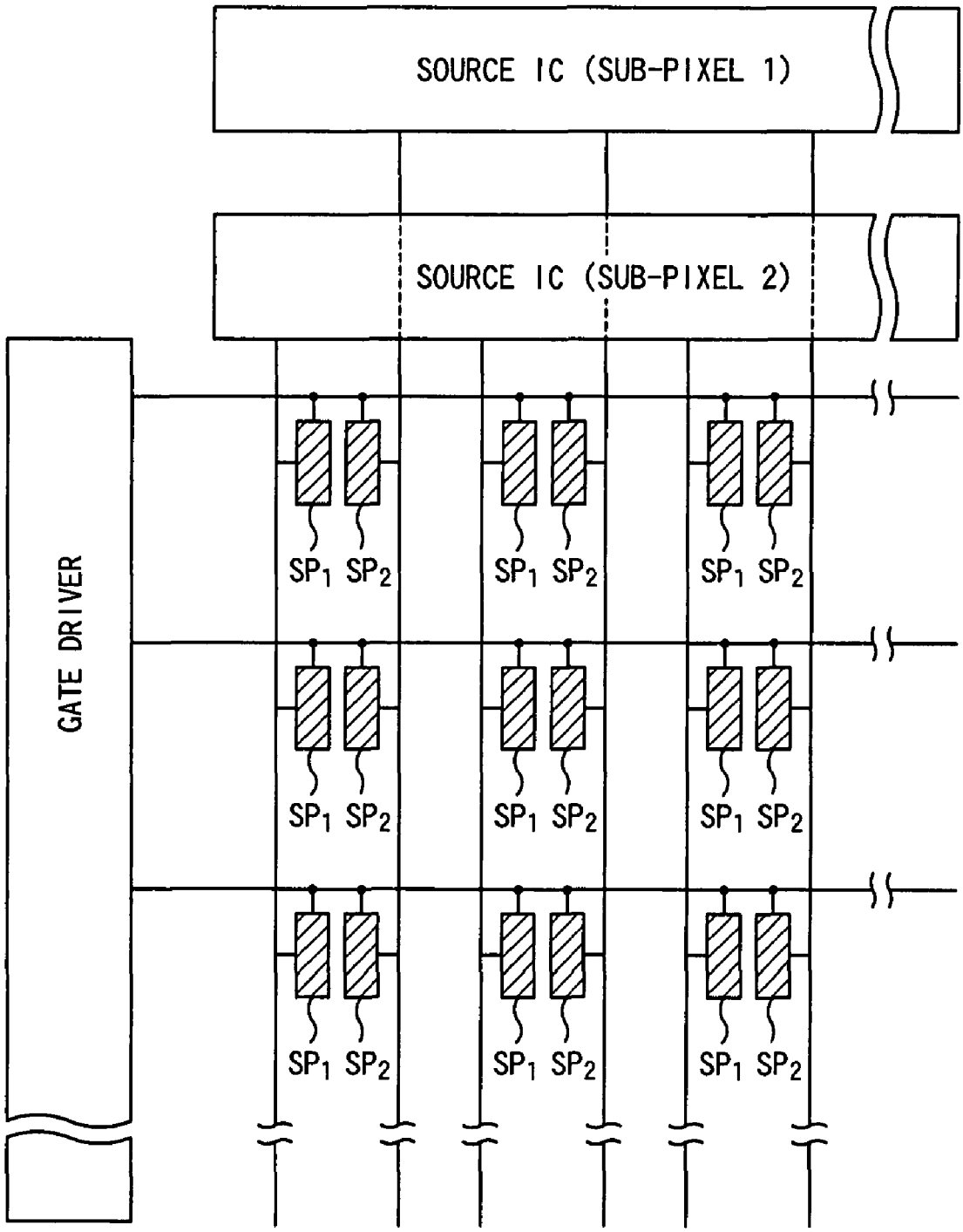
FIG. 27 shows a liquid crystal panel used in the second embodiment of the picture display apparatus according to the present invention.

The liquid crystal display panel 51 is shown schematically in FIG. 27.

In the liquid crystal display panel 51, each pixel, such as a pixel for R, is represented by two sub-pixels (first sub-pixel SP1 and second sub-pixel SP2) of two spatially neighboring regions. That is, the liquid crystal display panel 51 has the function of representing a pixel by two sub-pixels neighboring to each other.

In the liquid crystal display panel 51, electrodes are mounted on the liquid crystal at a spatial position in register with the first sub-pixel P1 and on the liquid crystal at a spatial position in register with the second sub-pixel P2, and are driven independently.

The interpolator 11 is supplied from outside with a digital picture signal having a picture rate of 60 Hz. The interpolator 11 converts the picture rate of 60 Hz of the picture signal to a double picture rate, that is, 120 Hz.

The picture signal of the picture rate of 120 Hz, output from the interpolator 11, is supplied to the first sub-pixel processor 52-1 and to the second sub-pixel processor 52-2.

The first sub-pixel processor 52-1 and a second sub-pixel processor 52-2 are of the same inner structure, and are provided respectively with over-drive units 12-1, 12-2, angle of visibility improvement units 13-1, 13-2, convert-to-A.C. units 14-1, 14-2 and source drivers 15-1, 15-2.

The first sub-pixel processor 52-1 generates a driving signal for driving the first sub-pixel of the liquid crystal display panel 51 based on the input picture signal. The second sub-pixel processor 52-2 generates a driving signal for driving the second sub-pixel of the liquid crystal display panel 51 based on the input picture signal.

An output signal of the first sub-pixel processor 52-1 is supplied to the liquid crystal display panel 51 as a signal driving the first sub-pixel. An output signal of the second sub-pixel processor 52-2 is supplied to the liquid crystal display panel 51 as a signal driving the second sub-pixel.

In the liquid crystal display apparatus 50, described above, the angle of visibility is improved by applying spatial modulation employing the first and second sub-pixels. That is, the first sub-pixel is displayed with a grayscale level higher than the inherent grayscale level, while the second sub-pixel is displayed with a grayscale level lower than the inherent grayscale level. When a human being views spatially consecutive pixels, he/she will recognize the averaged luminance of the two pixels. Hence, with such modulation, the human being recognizes that he/she is viewing a picture which is the same as the inherent picture. The reason the angle of visibility is improved by this grayscale modulation is the same as described above in connection with the principle of improving the angle of visibility by the temporally consecutive pixels.

In the liquid crystal display apparatus 50, 120 Hz interpolation of the picture signal is effected as temporal modulation, in combination with the above-described spatial modulation, such as to improve the angle of visibility.

Figure 28:
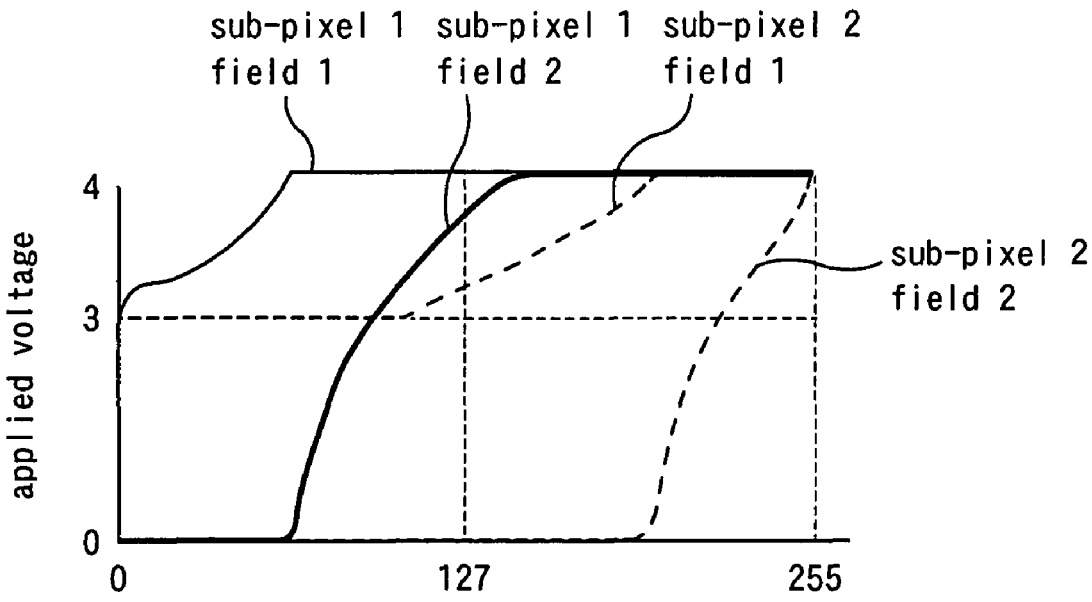
FIG. 28 shows a first gamma pattern in the second embodiment of the picture display apparatus according to the present invention.
Figure 29:
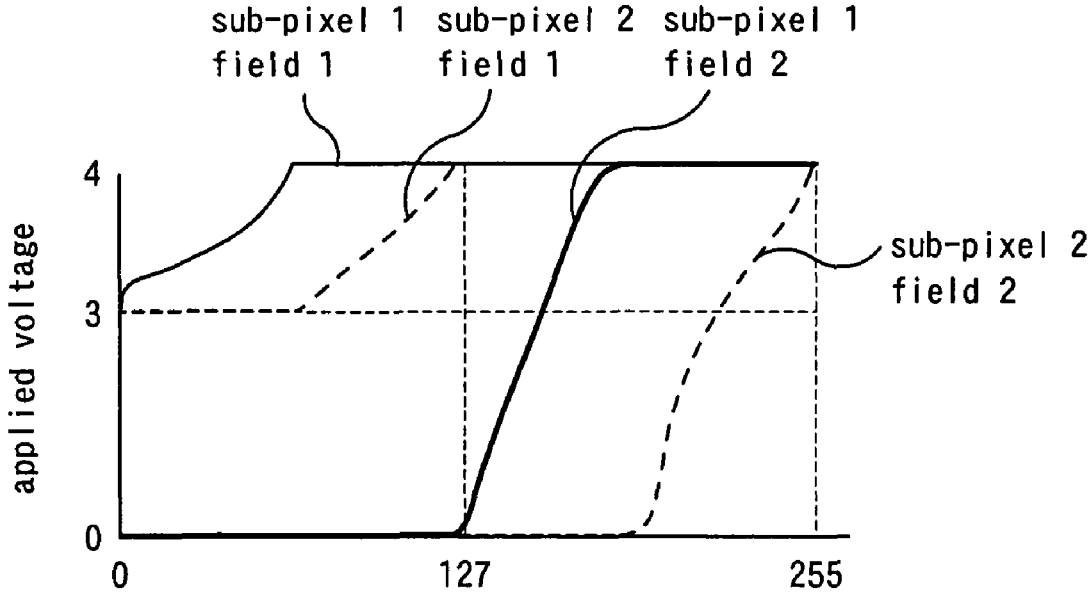
FIG. 29 shows a second gamma pattern in the second embodiment of the picture display apparatus according to the present invention.
Figure 30:
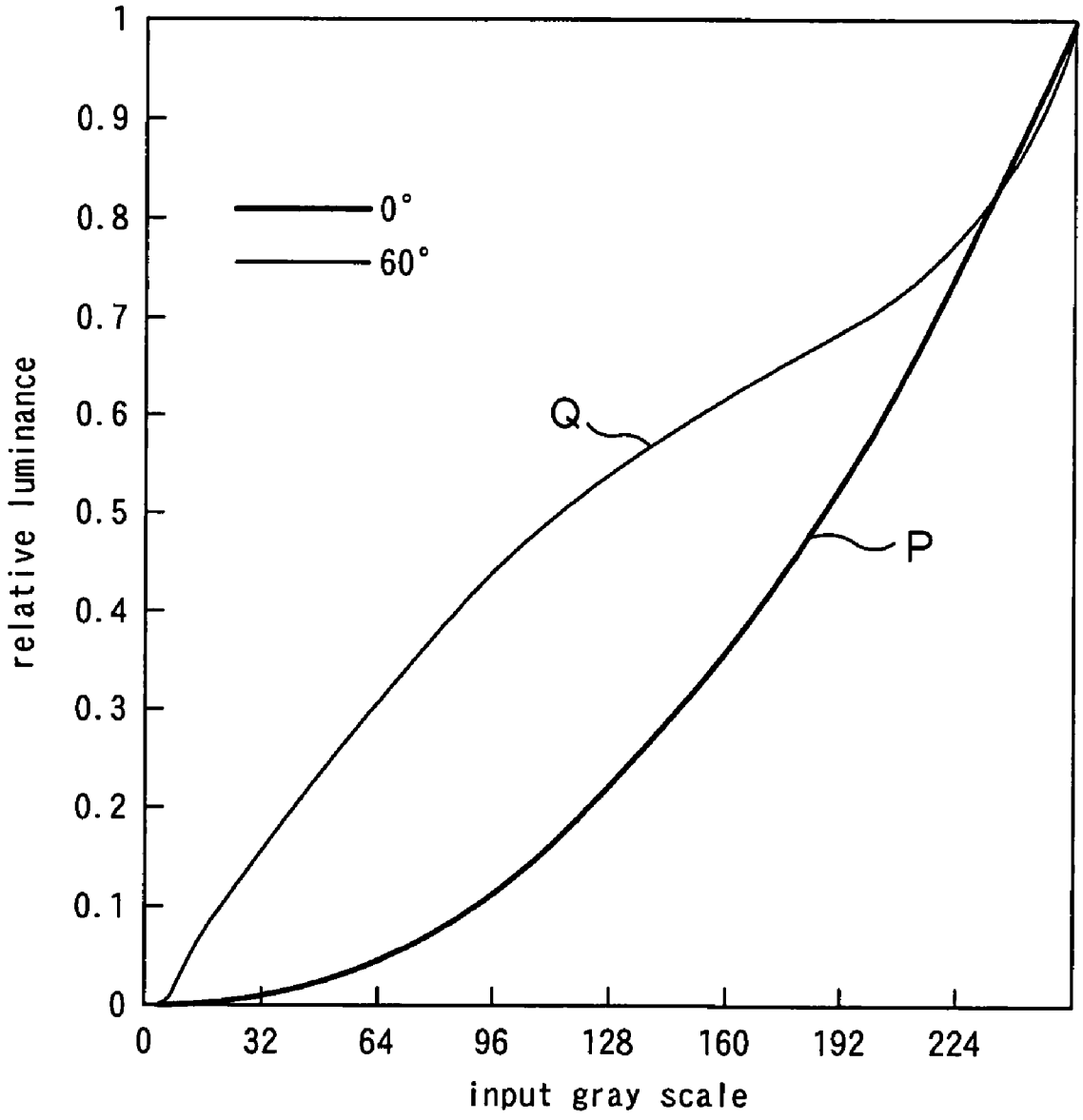
FIG. 30 is a curve showing input/output characteristics for the angle of visibility of a conventional liquid crystal display panel of 0° and 60°.

FIGS. 28 and 29 show patterns of a gamma converter in the angle of visibility improvement unit 13.

The patterns of gamma (γ) to be afforded to the sub-pixels and two fields for representing a sole grayscale level, with the use in combination of the spatial modulation and the temporal modulation, may roughly be divided into the following two patterns:

<First γ Pattern (FIG. 28)>

With the first sub-pixel, the grayscale level lower than the half-tone is represented by two fields. The respective fields of the second sub-pixel are each of a voltage of the black level or the level close to the black level. As for the grayscale level higher than the halftone, each field of the first sub-pixel is of the grayscale level of the white level or the level close to the white level and each field of the second sub-pixel mainly expresses the grayscale level difference.

<Second γ Pattern (FIG. 29)>

The grayscale level lower than the halftone is represented by two sub-pixels of the first field period. A voltage corresponding to the black level or the level close to the black level is applied to the second field. As for the grayscale level higher than the halftone, a voltage corresponding to the white level or the level close to the white level is applied to the first sub-pixel, and the grayscale level difference is mainly expressed with two pixels during the second field period.

The over-drive processing is carried out on the liquid crystal display apparatus 50 as well. The over-drive processor may be implemented by setting optimum values for the respective sub-pixels for the same cases as described above in connection with the previous embodiment.

Although the present invention has so far been described with reference to preferred embodiments, the present invention is not to be restricted to the embodiments. It is to be appreciated that those skilled in the art can change or modify the embodiments without departing from the scope and spirit of the invention.

The invention claimed is:

1. A picture display apparatus for displaying a picture corresponding to an input picture signal via a liquid crystal display surface, comprising:

a driving level correction unit for correcting a driving level based on said input picture signal;

a converter for converting the grayscale level of a signal supplied thereto into a plurality of correction levels for expressing said grayscale level by synthesis of transmittances of a plurality of temporally consecutive fields; and a driving unit for driving said liquid crystal display surface by a driving signal generated via said driving level correction unit and said converter;

said converter generating said correction levels so that each picture image of said input picture signal includes at least a first field and a second field, said first field having transmittance converted to a transmittance corresponding to the grayscale level of said input picture signal added by a positive correction value; said second field having transmittance converted to a transmittance corresponding to the grayscale level of said input picture signal added by a negative correction value;

said driving level correction unit performing driving level correction of signal values of said first field or said second field or both, depending on effective response characteristics of the liquid crystal driven by said driving unit, in case time changes of the grayscale level have occurred at the same spatial position of said input picture signal; and said driving level correction unit computing the correction value of said driving level in accordance with (i) a first computing process when at least each of signal values of at least three consecutive fields representing a temporally previous grayscale level and a next grayscale level at a spatial position is less than a predetermined level, and (ii) a second computing process when the signal value of one of the at least three consecutive fields is larger than the predetermined level, wherein in the first computing process, a determination is made whether a signal value of a field of the at least three consecutive fields which is a temporally first field representing the previous grayscale level is not greater than a signal value of a field of the at least three consecutive fields which is a temporally first field representing the next grayscale level.

2. The picture display apparatus according to claim 1 wherein, in case the grayscale level has been changed at the same spatial position from the light grayscale level to the dark grayscale level, said driving level correction unit corrects at least the signal value of the first field at said spatial position, the transmittance of which is converted to a transmittance corresponding to the grayscale level of said input picture signal added by a negative correction value, to a light grayscale level side.

3. The picture display apparatus according to claim 1 wherein, in case the grayscale level has been changed at the same spatial position from the dark grayscale level to the light grayscale level, said driving level correction unit corrects at least the signal value of the second field at said spatial position, the transmittance of which is converted to a transmittance corresponding to the grayscale level of said input picture signal added by a positive correction value, to a dark grayscale level side.

4. The picture display apparatus according to claim 1 wherein said driving level correction unit refers at least to signal values of a plurality of fields representing a grayscale level at a spatial position, and to a signal value of a first one of another plurality of fields representing the next grayscale level at said spatial position to compute the correction value of said driving level.

5. The picture display apparatus according to claim 1 wherein said converter generates a corrected picture signal at each spatial position so that at least one of a plurality of fields which represent a grayscale level is of a maximum level or a minimum level.

6. The picture display apparatus according to claim 5 wherein said driving level correction unit computes a correction value of a driving level of each of a plurality of fields representing two or more consecutive grayscale levels at the same spatial position, based on the magnitudes of two or more consecutive grayscale levels at the same spatial position, or on relative magnitudes of signal values of said fields representing said two or more consecutive grayscale levels at the same spatial position.

7. The picture display apparatus according to claim 6 wherein, in case two consecutive grayscale levels at the same spatial position are both lesser than a preset halftone between said maximum level and said minimum level, said driving level correction unit compares a signal value of a first one of a plurality of fields representing a temporally previous grayscale level and a signal value of a first one of the same plurality of fields representing a subsequent grayscale level to compute a correction value of a driving level.

8. The picture display apparatus according to claim 6 wherein, in case at least each of signal values of a plurality of fields representing a grayscale level at the same spatial position or the value of a signal of a first one of another plurality of fields representing the next grayscale level at said same spatial position is not less than a preset halftone intermediate between said maximum level and said minimum level, said driving level correction unit computes a correction value of a driving level depending on whether the signal levels of at least three fields of the consecutive grayscale levels are increasing or decreasing monotonously, whether the signal value of a mid field is high or whether the signal value of said mid field is low.

9. The picture display apparatus according to claim 6 wherein said driving level correction unit includes a lookup table having stored therein correction values of driving levels for respective signal values of respective fields and wherein the correction value is calculated by having reference to said lookup table.

10. The picture display apparatus according to claim 6 wherein, if, in comparing the relative magnitudes of signal values at the same spatial position of respective fields representing two consecutive grayscale levels, the correction of the driving level at said spatial position was made in the past, said driving level correction unit refers to a signal level equivalent to transmittance reached after correction to compute the correction value of the driving level for each field.

11. The picture display apparatus according to claim 1 wherein said converter effects grayscale conversion in such a manner that a grayscale level of said input picture signal is expressed by a plurality of pixels or by a plurality of subpixels of a pixel neighboring to one another in the spatial direction on a liquid crystal display surface and, in combination therewith, by liquid crystal transmittances of a plurality of temporally consecutive fields.

12. The picture display apparatus according to claim 1 wherein said driver includes a polarity inverter for reversing the polarity of a driving signal for reversing the polarity of an electrical field to be applied to the liquid crystal on a liquid crystal display surface; said polarity inverter reversing the polarity at a period n times as large as the picture period of a plurality of fields used for expressing a grayscale level, where n is an integer not less than unity.

13. The picture display apparatus according to claim 1 wherein, when said converter synthesizes liquid crystal transmittances of a plurality of temporally consecutive fields, the average value of the synthesized liquid crystal transmittances is the gamma characteristics of the liquid crystal display surface conforming to the level of an input picture signal.

14. The picture display apparatus according to claim 1 further comprising an interpolator for increasing a picture rate of said input picture signal and for interpolating a plurality of picture images corresponding to the increased rate; said converter performing processing on the input picture signal having the picture rate increased by said interpolator.

15. A picture display method for displaying a picture corresponding to an input picture signal via a liquid crystal display surface, comprising:

a driving level correcting step of correcting a driving level based on said input picture signal;

a converting step of converting the grayscale level of a signal supplied thereto into a plurality of correction levels for expressing said grayscale level by synthesis of transmittances of a plurality of temporally consecutive fields; and a driving step of driving said liquid crystal display surface by a driving signal generated by said driving level correction step and said converting step ;

said converting step generating said correction levels so that each picture image of said input picture signal includes at least a first field and a second field, said first field having transmittance converted to a transmittance corresponding to the grayscale level of said input picture signal added by a positive correction value; said second field having transmittance converted to a transmittance corresponding to the grayscale level of said input picture signal added by a negative correction value;

said driving level correction step performing driving level correction of signal values of said first field or said second field or both, depending on effective response characteristics of the liquid crystal driven by said driving step, in case time changes of the grayscale level have occurred at the same spatial position of said input picture signal; and said driving level correction step computing the correction value of said driving level in accordance with (i) a first computing process when at least each of signal values of at least three consecutive fields representing a temporally previously grayscale level and a next grayscale level at a spatial position is less than a predetermined level, and (ii) a second computing process when the signal value of one of the at least three consecutive fields is larger than the predetermined level, wherein in the first computing process, a determination is made whether a signal value of a field of the at least three consecutive fields which is a temporally first field representing the previous grayscale level is not greater than a signal value of a field of the at least three consecutive fields which is a temporally first field representing the next grayscale level.

16. The picture display method according to claim 15 wherein, in case the grayscale level has been changed at the same spatial position from the light grayscale level to the dark grayscale level, said driving level correction step corrects at least the signal value of the first field at said spatial position, the transmittance of which is converted to the transmittance corresponding to the grayscale level of said input picture signal added by a negative correction value, to a light grayscale level side.

17. The picture display method according to claim 15 wherein, in case the grayscale level has been changed at the same spatial position from the dark grayscale level to the light grayscale level, said driving level correction step corrects at least the signal value of the second field at said spatial position, the transmittance of which is converted to the transmittance corresponding to the grayscale level of said input picture signal added by a positive correction value, to a dark grayscale level side.

18. The picture display method according to claim 15 wherein said driving level correction step refers at least to signal values of a plurality of fields representing a grayscale level at a spatial position and to a signal value of a first one of another plurality of fields representing the next grayscale level at said spatial position to compute the correction value of said driving level.

19. The picture display method according to claim 15 wherein said converter generates a corrected picture signal at each spatial position so that at least one of a plurality of fields which represent a grayscale level is of a maximum level or a minimum level.

20. The picture display method according to claim 19 wherein said driving level correction step computes a correction value of a driving level of each of a plurality of fields representing two or more consecutive grayscale levels at the same spatial position based on the magnitudes of said two or more consecutive grayscale levels at the same spatial position or on relative magnitudes of signal values of said fields representing two or more consecutive grayscale levels at the same spatial position.

21. The picture display method according to claim 20 wherein, in case two consecutive grayscale levels at the same spatial position are both lesser than a preset halftone between said maximum level and said minimum level, said driving level correction step compares a signal value of a first one of a plurality of fields representing a temporally previous grayscale level and a signal value of a first one of the same plurality of fields representing a subsequent grayscale level to compute a correction value of a driving level.

22. The picture display method according to claim 20 wherein, in case at least each of signal values of a plurality of fields representing a grayscale level at the same spatial position or the value of a signal of a first one of another plurality of fields representing the next grayscale level at said same spatial position is not less than a preset halftone intermediate between said maximum level and said minimum level, said driving level correction step computes a correction value of a driving level depending on whether the signal levels of at least three fields of the consecutive grayscale levels are increasing or decreasing monotonously, whether the signal value of a mid field is high or whether the signal value of said mid field is low.

23. The picture display method according to claim 20 wherein said driving level correction step includes a lookup table having stored therein correction values of driving levels for respective signal values of respective fields and wherein the correction value is calculated by having reference to said lookup table.

24. The picture display method according to claim 20 wherein, if, in comparing the relative magnitudes of signal values at the same spatial position of respective fields representing two consecutive grayscale levels, the correction of the driving level at said spatial position was made in the past, said driving level correction step refers to a signal level equivalent to transmittance reached after correction to compute the correction value of the driving level for each field.

25. The picture display method according to claim 15 wherein said converter effects grayscale conversion in such a manner that a grayscale level of said input picture signal is expressed by a plurality of pixels or by a plurality of subpixels of a pixel neighboring to one another in the spatial direction on a liquid crystal display surface and, in combination therewith, by liquid crystal transmittances of a plurality of temporally consecutive fields.

26. The picture display method according to claim 15 wherein said driver includes a polarity inverter for reversing the polarity of a driving signal for reversing the polarity of an electrical field to be applied to the liquid crystal on a liquid crystal display surface; said polarity inverter reversing the polarity at a period n times as large as the picture period of a plurality of fields used for expressing a grayscale level, where n is an integer not less than unity.

27. The picture display method according to claim wherein, when said converter synthesizes liquid crystal transmittances of a plurality of temporally consecutive fields, the average value of the synthesized liquid crystal transmittances is the gamma characteristics of the liquid crystal display surface conforming to the level of an input picture signal.

28. The picture display method according to claim further comprising an interpolating step for increasing a picture rate of said input picture signal and for interpolating a plurality of picture images corresponding to the increased rate; said converting step performing processing on the input picture signal having the picture rate increased by said interpolator.

* * * * *